US007900642B2

(12) United States Patent
Lavender et al.

(10) Patent No.: US 7,900,642 B2
(45) Date of Patent: Mar. 8, 2011

(54) WASHING APPARATUS

(75) Inventors: Henry William Raimund Lavender, Auckland (NZ); Johannes Christiaan Bartlema, Christchurch (NZ); Philip Jeffrey O'Reilly, Auckland (NZ)

(73) Assignee: Rapcorp Limited, Auckland (NZ)

( * ) Notice: Subject to any disclaimer, the term of this patent is extended or adjusted under 35 U.S.C. 154(b) by 1182 days.

(21) Appl. No.: 11/544,658

(22) Filed: Oct. 10, 2006

(65) Prior Publication Data

US 2008/0083434 A1 Apr. 10, 2008

(51) Int. Cl.
*B08B 3/02* (2006.01)

(52) U.S. Cl. ..... 134/900; 68/213

(58) Field of Classification Search ..... 134/900; 68/213

See application file for complete search history.

(56) References Cited

U.S. PATENT DOCUMENTS

| | | | | | |
|---|---|---|---|---|---|
| 2,007,029 | A * | 7/1935 | Uhri, Jr. | 239/8 |
| 2,938,368 | A * | 5/1960 | Bixel | 68/205 R |
| 3,133,548 | A * | 5/1964 | Carr | 134/138 |
| 3,472,251 | A * | 10/1969 | Parker, Jr. | 134/138 |
| 3,732,593 | A * | 5/1973 | Habostad | 15/257.06 |
| 4,061,153 | A * | 12/1977 | Doherty | 134/138 |
| 4,108,189 | A * | 8/1978 | Claiborne et al. | 134/138 |
| 4,513,925 | A * | 4/1985 | Yamaguchi | 242/245 |
| 4,569,099 | A | 2/1986 | Harding | |
| 5,423,913 | A * | 6/1995 | Fontaine | 118/63 |
| 5,614,021 | A * | 3/1997 | Catlin | 118/258 |
| 5,626,158 | A | 5/1997 | Gratopp | |
| 5,651,381 | A | 7/1997 | Balouchian | |
| 5,797,410 | A | 8/1998 | Gates | |
| 6,779,535 | B2 * | 8/2004 | Drukarov | 134/198 |
| 7,325,556 | B2 * | 2/2008 | Walter | 134/138 |
| 7,435,030 | B2 * | 10/2008 | Atterbury | 401/219 |

FOREIGN PATENT DOCUMENTS

GB 2 286 961 * 9/1995

* cited by examiner

*Primary Examiner* — Frankie L Stinson
(74) *Attorney, Agent, or Firm* — Young & Thompson

(57) ABSTRACT

A washing apparatus has a housing comprising a spray element such that in use, fluid is forced through at least one aperture creating a substantially elongate spray onto at least one roller wheel or roller sleeve substantially causing the roller wheel to spin and be washed or cleaned. A method of washing a roller in a washing apparatus is also disclosed. The apparatus includes a housing comprising a spray element such that in use, fluid is forced through at least one aperture creating a substantially elongate spray onto at least one roller wheel or roller sleeve substantially causing the roller wheel to spin and be washed or cleaned wherein the following steps include: inserting roller therein by opening the apparatus or sliding the roller therein; connecting the apparatus to a fluid supply element such as a faucet or hose; and initiating fluid flow to wash or clean the roller.

20 Claims, 22 Drawing Sheets

15
6
9

10
13
9
12
14
11
7
6
14
2

3

3
7
8
11

7
11
4
12b
20
9

4
17
12
18
9
19
20
3
16

4
9
12a
20

SECTION E-E

WASHING APPARATUS

FIELD OF INVENTION

This invention relates to a washing apparatus. The invention is directed particularly but not solely toward a washing apparatus for paint rollers which can also be used as a marketing device.

BACKGROUND OF THE INVENTION

Washing or cleaning paint rollers can be extremely time consuming and messy. Paint rollers are often improperly washed and therefore have to be replaced at some cost to the consumer. Existing roller cleaners or washing apparatus are costly to both consumers and manufactures and are difficult to operate.

Washing with water based paints and even after solvent based paints have been used, can involve a huge use of water. Normally this water must be paid for and must be properly disposed of. Disposal is often down outside drains or inside sinks.

Environmentally it is not acceptable to dispose down drains as this pollutes waterways and the sea whereas disposal in the sink though more environmentally sound, as this goes to a sewer or wastewater systems, high volumes can still put pressure on these waste system causing overflow and pollution.

OBJECT OF THE INVENTION

It is the object of the present invention to provide a washing apparatus which will obviate or minimise some if not all the aforementioned problems in a simple yet effective manner and/or which will at least provide the public with a useful choice.

STATEMENT OF INVENTION

Accordingly in one aspect the invention may broadly be said to consist in a washing apparatus which provides a housing comprising a spray means such that in use, fluid is forced through at least one aperture creating a substantially elongate spray onto at least one roller wheel or roller sleeve substantially causing the roller wheel to spin and be washed or cleaned.

Preferably the aperture is openable during use and the spray is applied to substantially the complete length of the roller.

Alternatively the spray means is a fan spray means.

Preferably the spray hits the roller in a tangential manner causing the roller to spin creating a centrifugal force, with the fluid and any contents in the roller, being thrown out of the roller.

Preferably, the housing in use is provided by a first part and a second part wherein the first part has an outer surface, which in use faces a user and an inner surface which is distal to the user, wherein the first part and second part form a first cavity therebetween, being constructed to produce the spray means.

Preferably, the first cavity is provided with a fluid inlet and a fluid outlet wherein the fluid outlet forms the openable aperture.

Preferably, the fluid flow is continuous to enable the elongate spray to be maintained.

Preferably, the first part has a strengthening means that assists in maintaining fluid pressure on the aperture for the maintenance of an even elongate spray by preventing the aperture from opening unequally at any point along the aperture.

Preferably the second part has a strengthening means that assists in the creation and maintenance of the elongate spray.

Preferably the raised portion is moulded in such a way with an arc shaped fold across its width, that loads extra rigidity to the central area of the aperture in order to create an even elongate spray across its width.

Preferably, at least one raised portion or rib provides the strengthening means.

Alternatively, a curved or angled portion provides the strengthening means which can be mutually opposing curved portions of the first and second parts are brought together during assembly of the apparatus, pre-stressing occurs in the centre to provide equal resistance such that the portions react substantially equally to produce a even substantially even aperture and elongate spray therefrom.

A curved or angled portion of the rib provides the raised portion wherein the rib is adjacent the aperture.

Preferably, the first part has a shield portion in the form of a recess in which the roller wheel or sleeve sits within but is spaced apart to be washed by an elongate spray directed at the top of the roller or sleeve.

Preferably, the first part is fluidly sealed to the second part to form the first cavity.

Preferably, the aperture is elongate.

Preferably in use the apparatus has a top and a base and the apparatus is adapted to sit vertically, wherein the base is provided with legs.

Preferably, the fluid inlet is provided with a connecting means, the connecting means having a nozzle and tubing having a cavity connecting distal end, which before use can be in a retracted position or not within the first cavity such that during use, that the connecting distal end is frictionally held at the fluid inlet and the nozzle is removably connectable to a fluid supply thereby allowing the apparatus to be useable by being attachable to a faucet or tap adjacent to a sink or drain.

Preferably the aperture is formed by two portions being pre-stressed or outwardly curved, to form a closed elongate aperture such that the aperture only opens evenly under predetermined fluid pressure to produce the elongate spray.

Preferably, the first part has a lip portion with holding means to hold a paint roller in place, wherein the lip portion is designed to releasably hold a section of the roller handle, rigidly to the apparatus when in use so as to prevent lateral or twist motion, by being captively retained when the first and second parts are together.

Alternatively the first part has at least one landing means, in use to captively retain the shaft of a paint roller when used in the apparatus.

Preferably a first landing means is provided in the inner surface of the first part closest to the handle portion of the paint roller and a second landing means is provided in the first part inner surface adjacent to an end of the roller when a roller in use is placed in the apparatus.

Preferably the first landing means comprises a grooved portion having a partial roof portion, adjacent an end wall of the first part and the second landing means comprises recess portion between a raised and non-raised pedestal portion.

Preferably the first part has a tunnel portion in use to envelop the handle part of a roller, distal to the handle end.

Preferably, the washing apparatus is designed for multiple use with the roller being able to be extracted and installed repeatedly for washing as required.

Preferably, the washing apparatus is moulded by a vacuum forming process.

Preferably, the washing apparatus is moulded by an injection moulding process.

Preferably the washing apparatus is stackable or nestable.

Preferably the washing apparatus is adapted to provide advertising thereon.

Preferably the apparatus is fabricated from substantially PVC plastics.

Accordingly in another aspect the invention may broadly be said to consist in a method of washing a roller in a washing apparatus which provides a housing comprising a spray means such that in use, fluid is forced through at least one aperture creating a substantially elongate spray onto at least one roller wheel or roller sleeve substantially causing the roller wheel to spin and be washed or cleaned wherein the following steps include:

inserting roller therein by opening the apparatus or sliding the roller therein;

connecting the apparatus to a fluid supply means such as a faucet or hose;

initiating fluid flow to wash or clean the roller.

DRAWING DESCRIPTION

Embodiments of the invention will now be described by way of example only, with reference to the accompanying drawings.

Figures 4, 5, 6, 8, 8A, 8B:
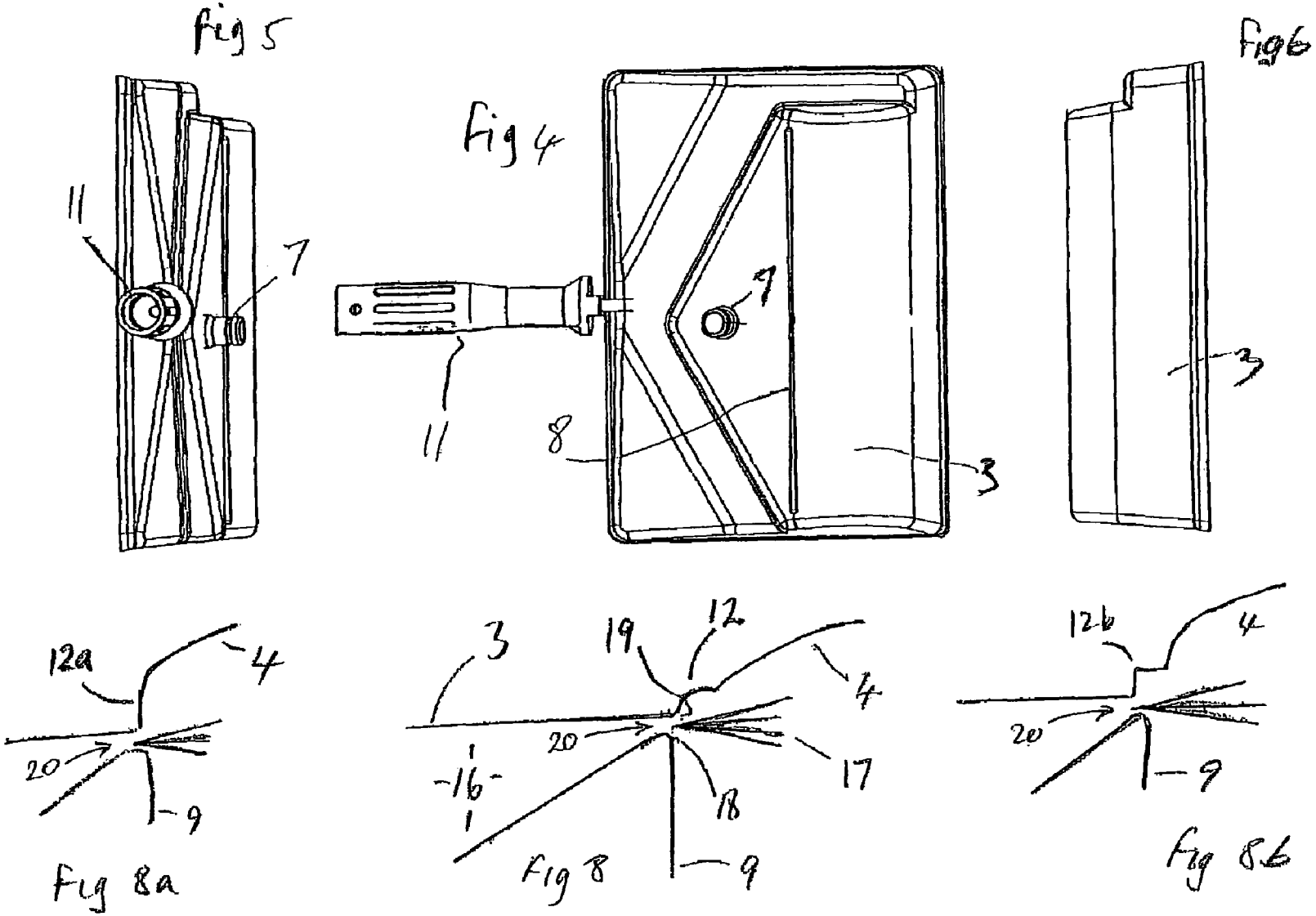
FIG. 4 shows a plan view of the apparatus of FIG. 1.
FIG. 5 shows an end view of the apparatus of FIG. 4.
FIG. 6 shows another end view of the apparatus of FIG. 4.
FIG. 8 shows a close up of the cross-section view of part of FIG. 7 showing the formation of the spray.
Figure 7:
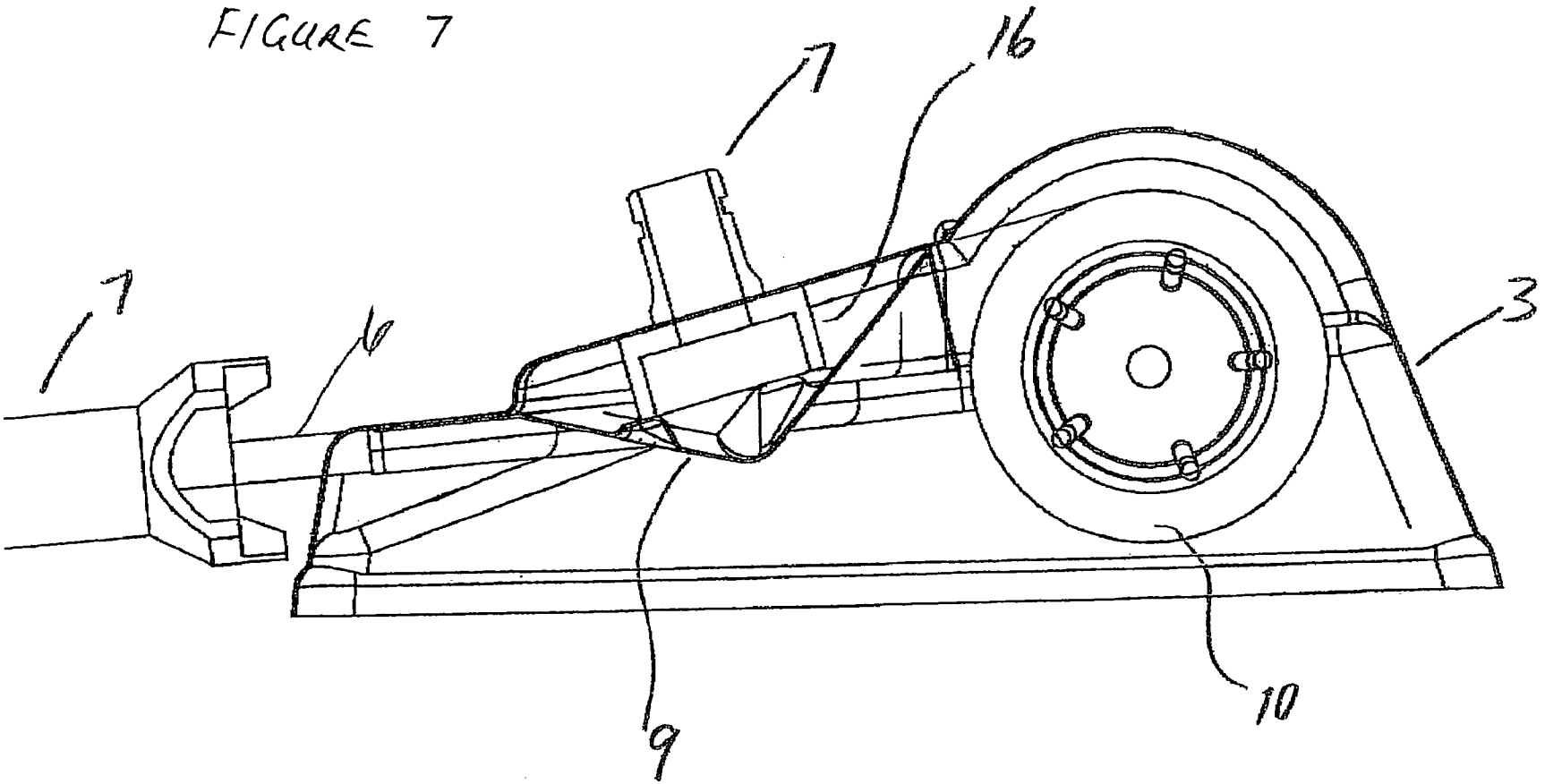
FIG. 7 shows a cross-sectional side view of the washing apparatus having, a paint roller clipped in place and the cavity between the first and second parts.

FIG. 8*a* shows a close up of the cross-section view of part of FIG. 7 showing the formation of the spray in a second version.

FIG. 8*b* shows a close up of the cross-section view of part of FIG. 7 showing the formation of the spray, in a third version.

Figure 9:
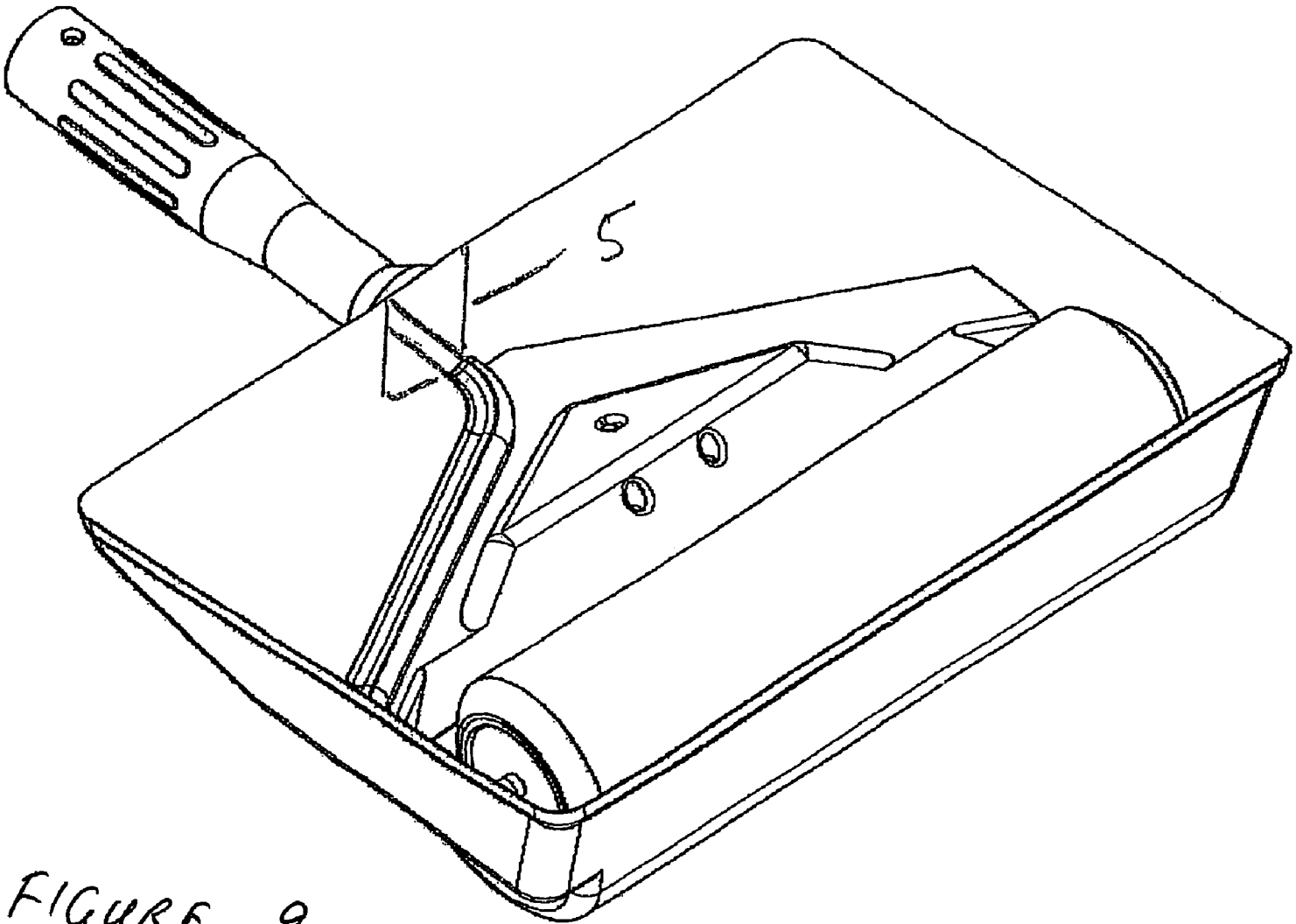

FIG. 9 is a perspective view of underneath the washing apparatus.

Figure 10:
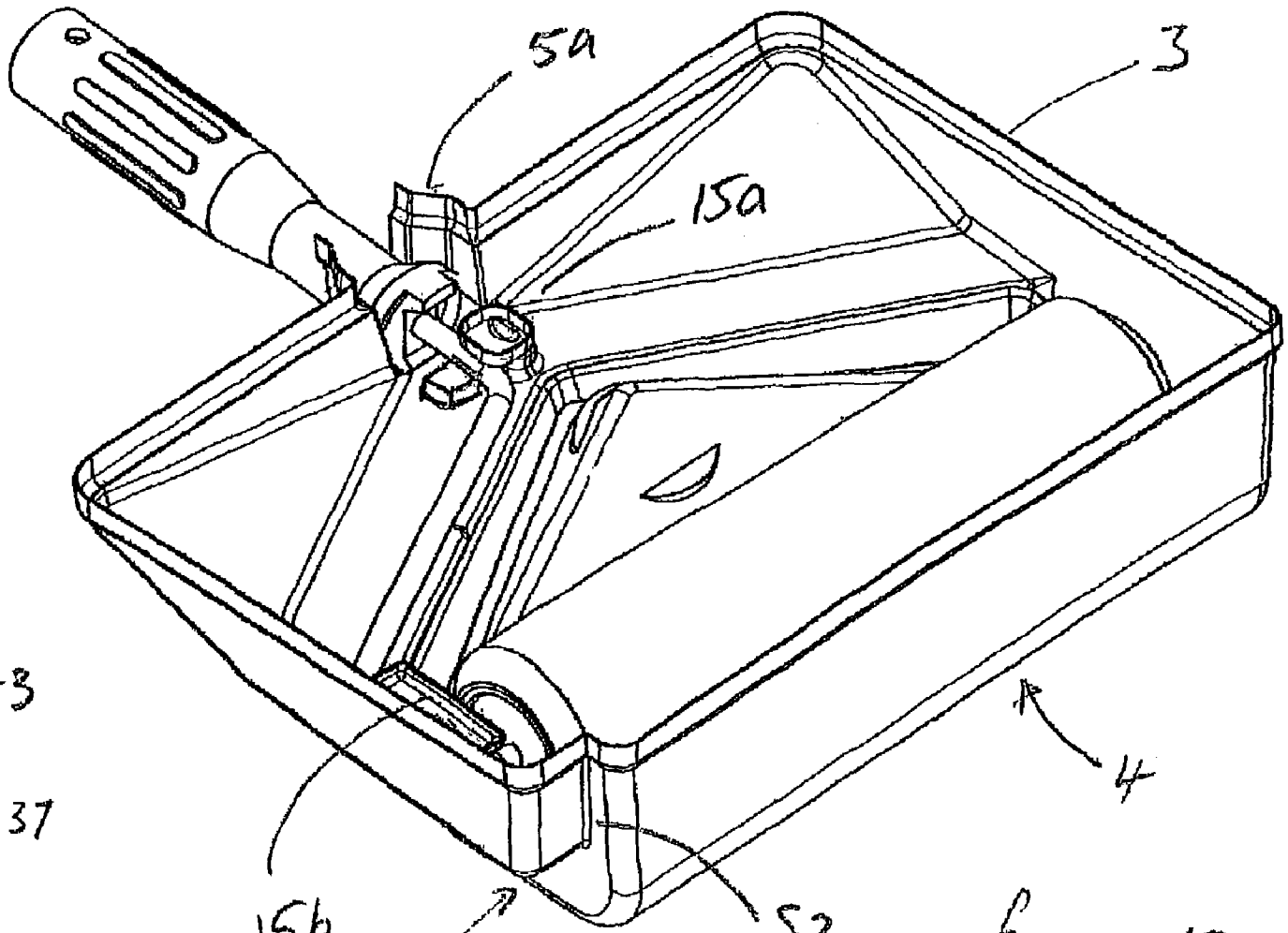

FIG. 10 is a perspective view of underneath the washing apparatus having further features.

Figure 11:
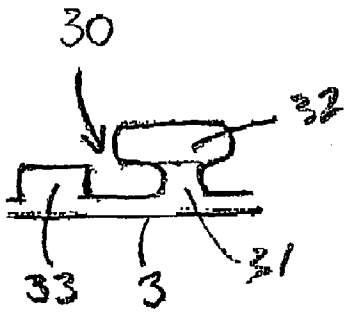

FIG. 11 is a cross section of a first shaft landing means.

Figure 12:
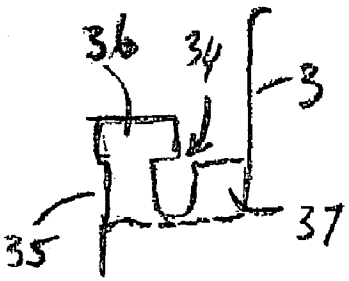

FIG. 12 is a cross section of a second shaft landing means.

Figure 13:
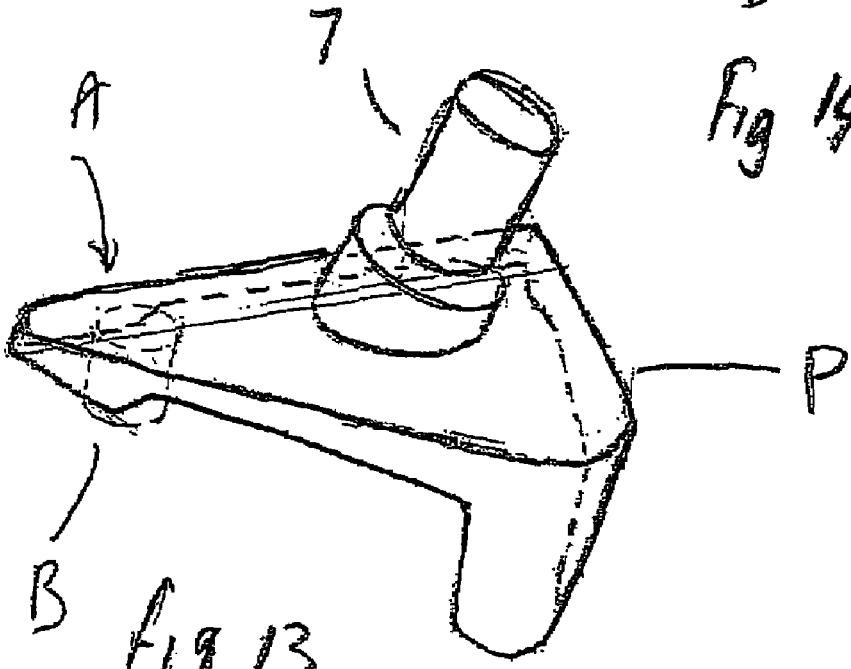

FIG. 13 shows a perspective of an alternative fluid connection.

Figure 14:
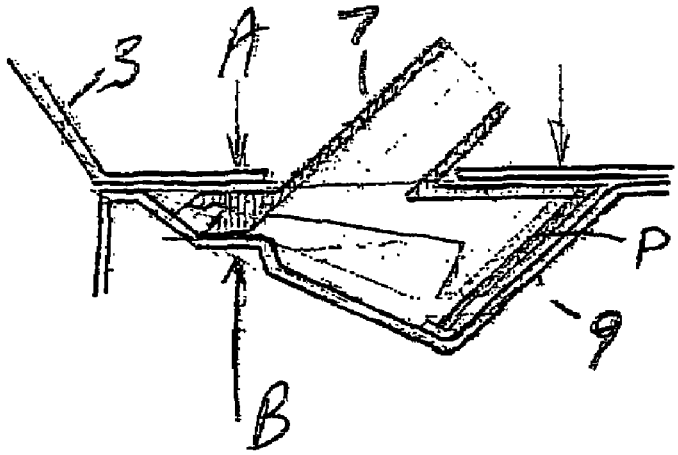

FIG. 14 shows a cross section of an alternative fluid connection.

Figure 15:
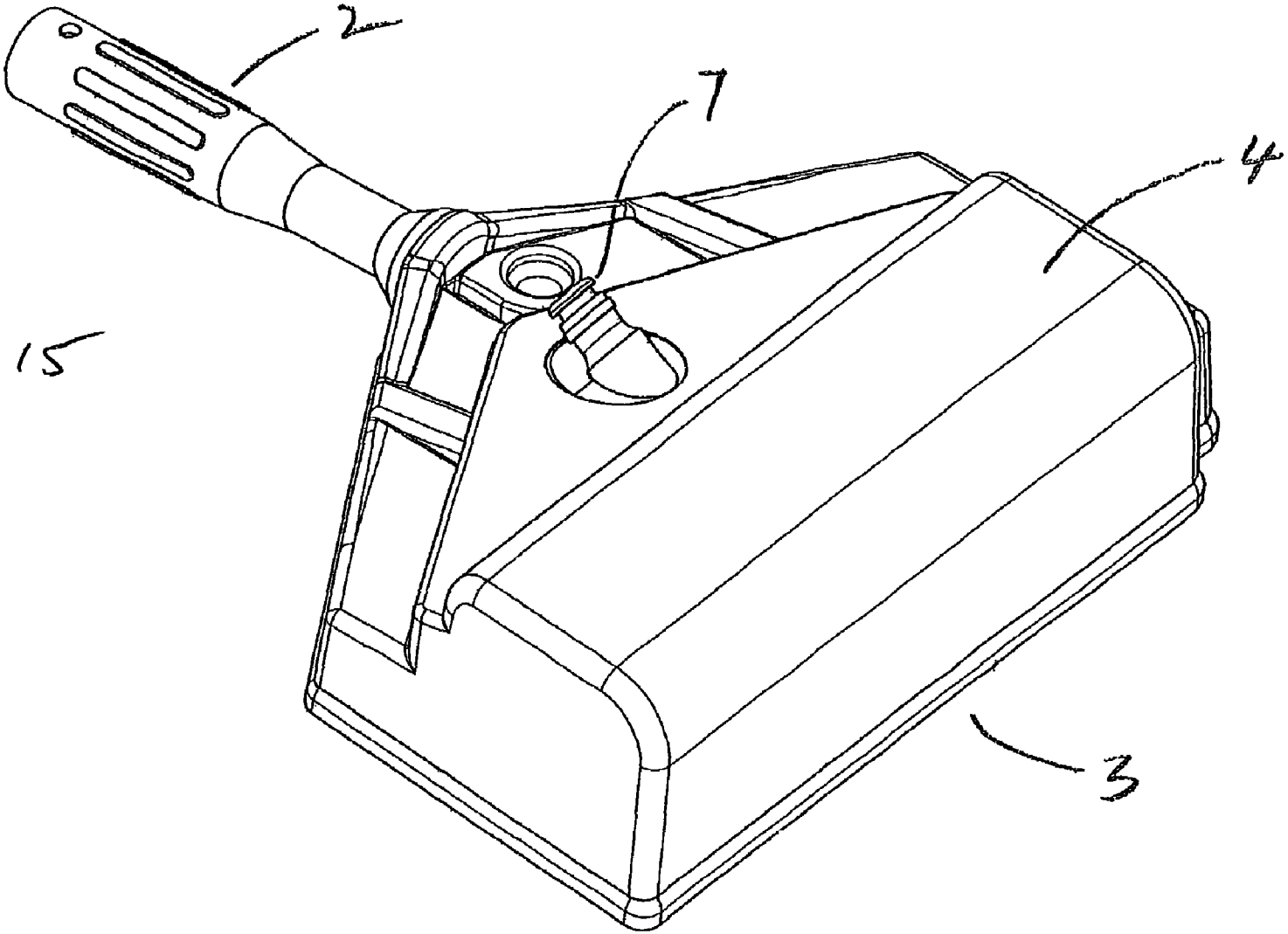

FIG. 15 is a perspective first view of a second embodiment of the washing apparatus.

Figure 16:
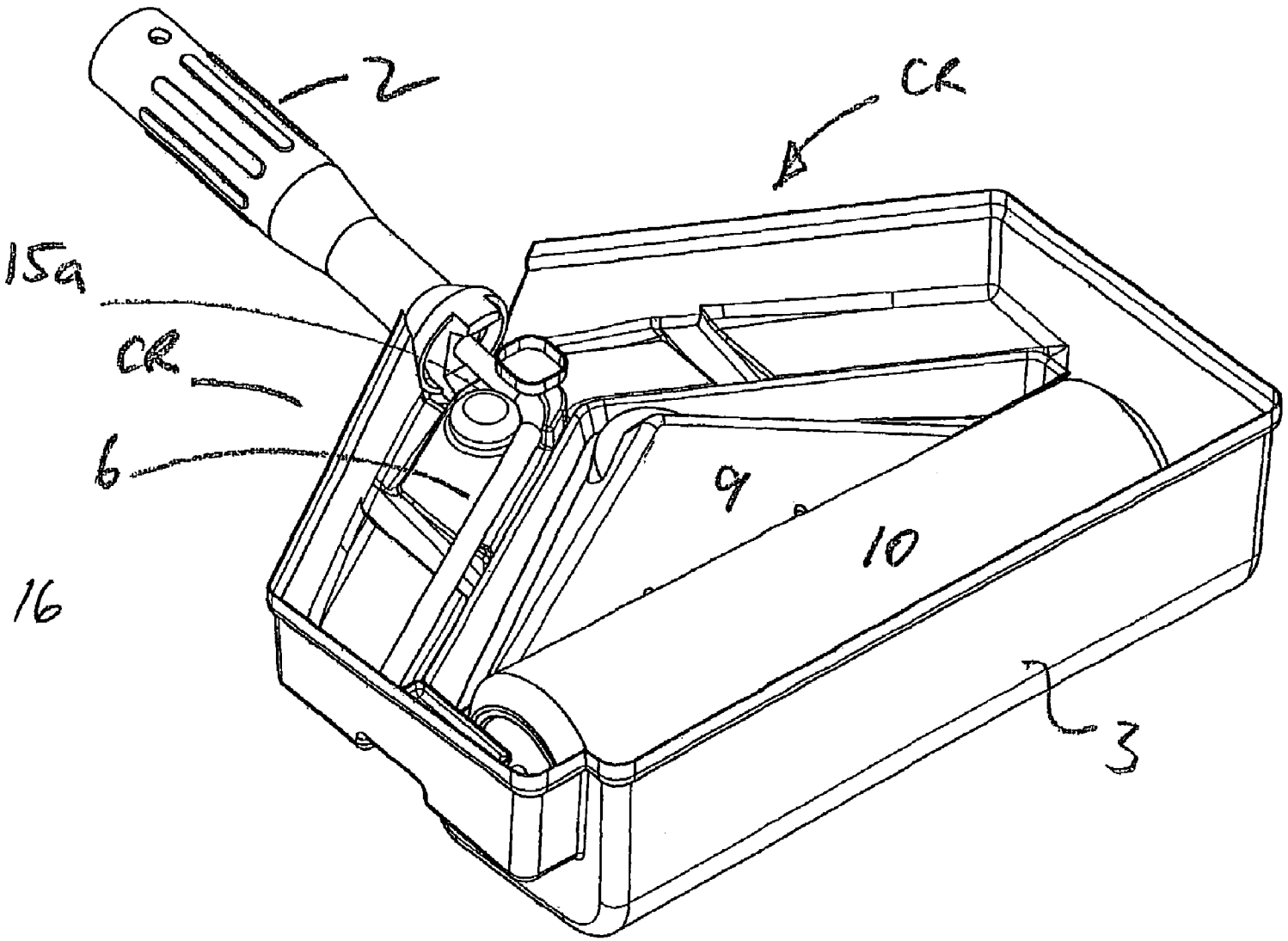

FIG. 16 is a perspective underneath view of the apparatus of FIG. 15.

Figure 17:
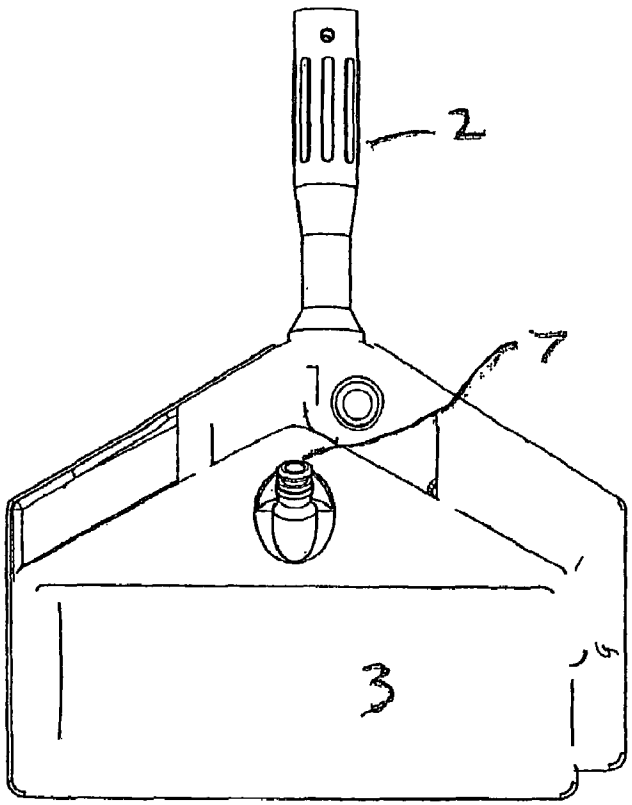

FIG. 17 is a first view of the apparatus of FIG. 15.

Figure 18:
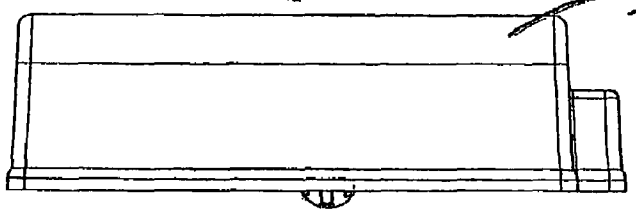

FIG. 18 is a first end view of the apparatus of FIG. 15.

Figure 19:
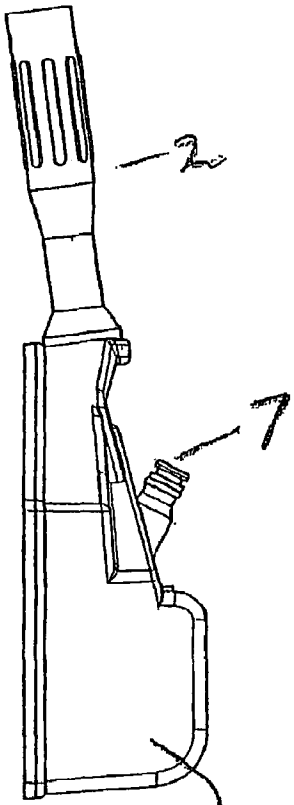

FIG. 19 is a second end view of the apparatus of FIG. 15.

Figure 20:
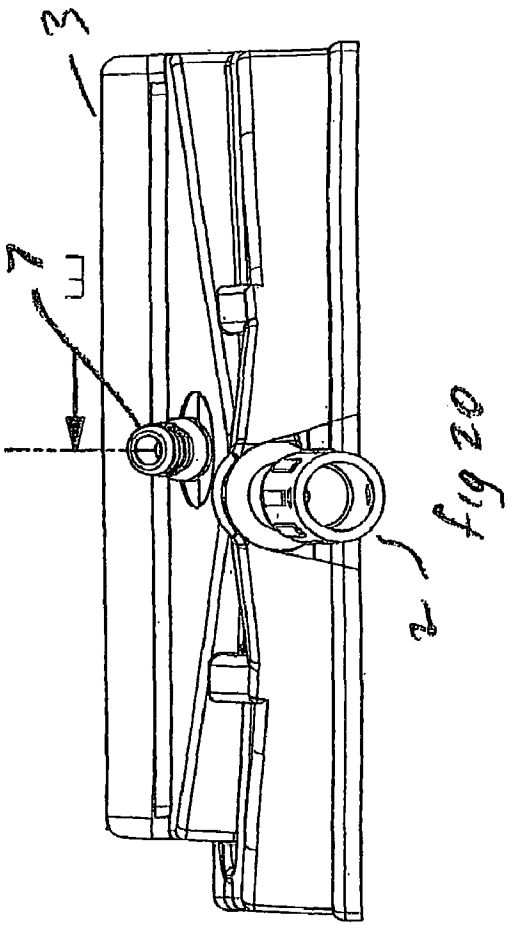

FIG. 20 is a third end view of the apparatus of FIG. 15.

Figure 21:
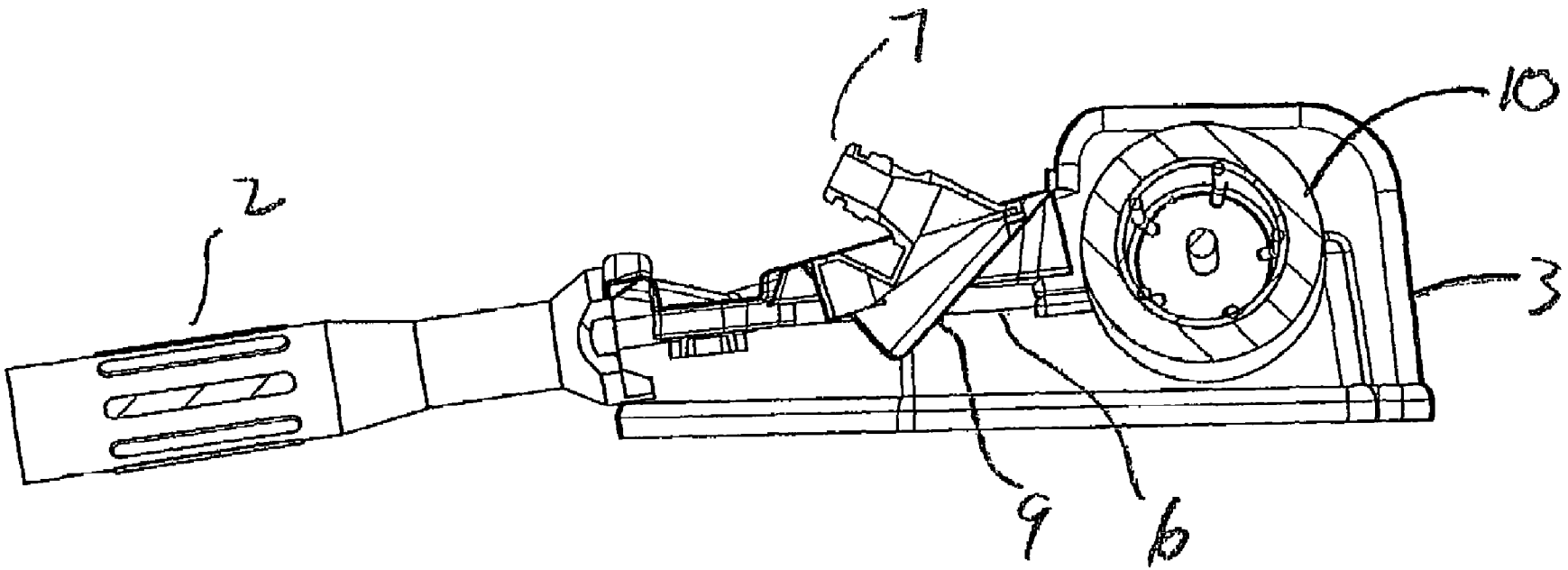

FIG. 21 is a cross section of the apparatus of FIG. 15 with a paint roller in use.

Figure 22:
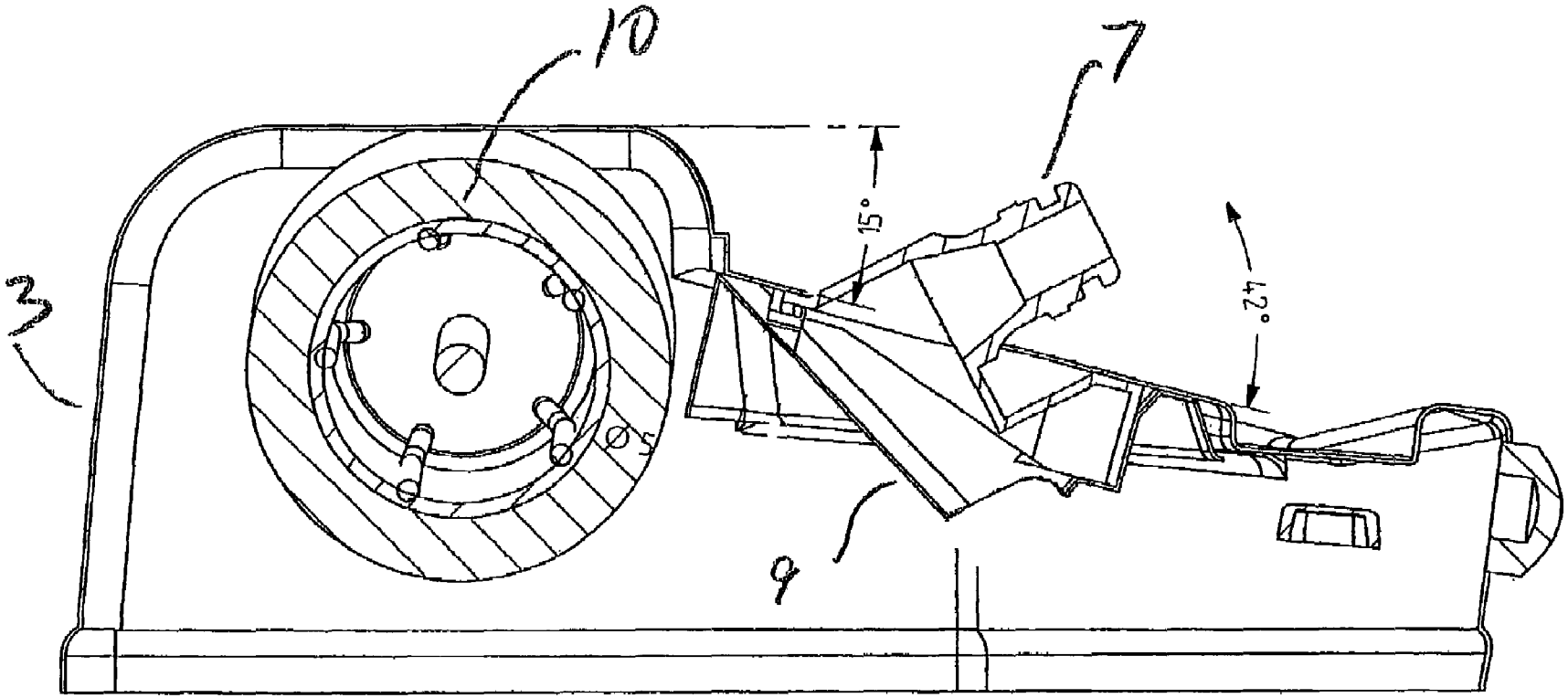

FIG. 22 is a close up cross section of the apparatus of FIG. 15 with a roller of a paint roller in use.

Figure 23:
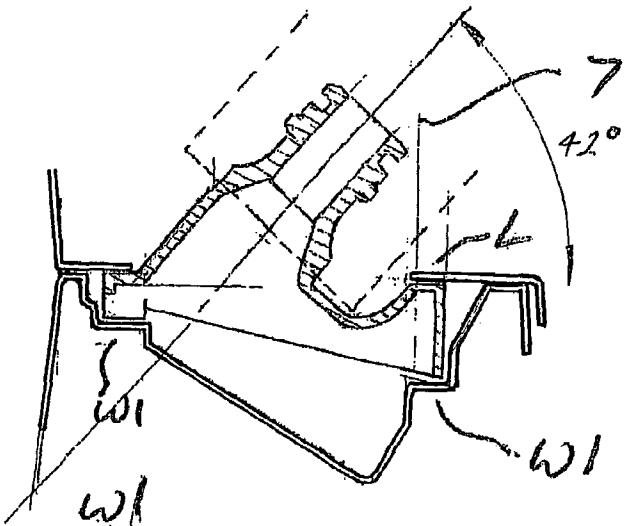

FIG. 23 is a cross section of an alternative fluid inlet.

Figure 24:
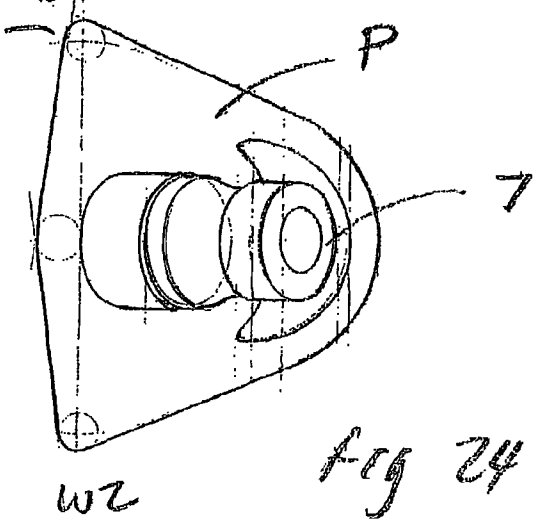

FIG. 24 is perspective view of the fluid inlet of FIG. 23.

Figure 25:
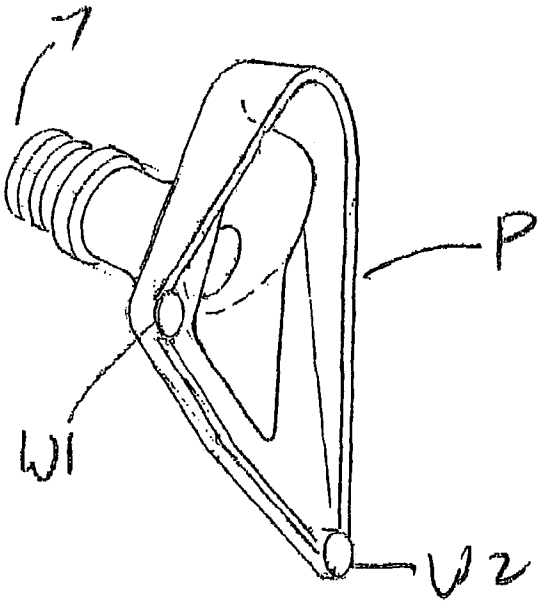

FIG. 25 is another perspective view of the fluid inlet of FIG. 23.

Figure 26:
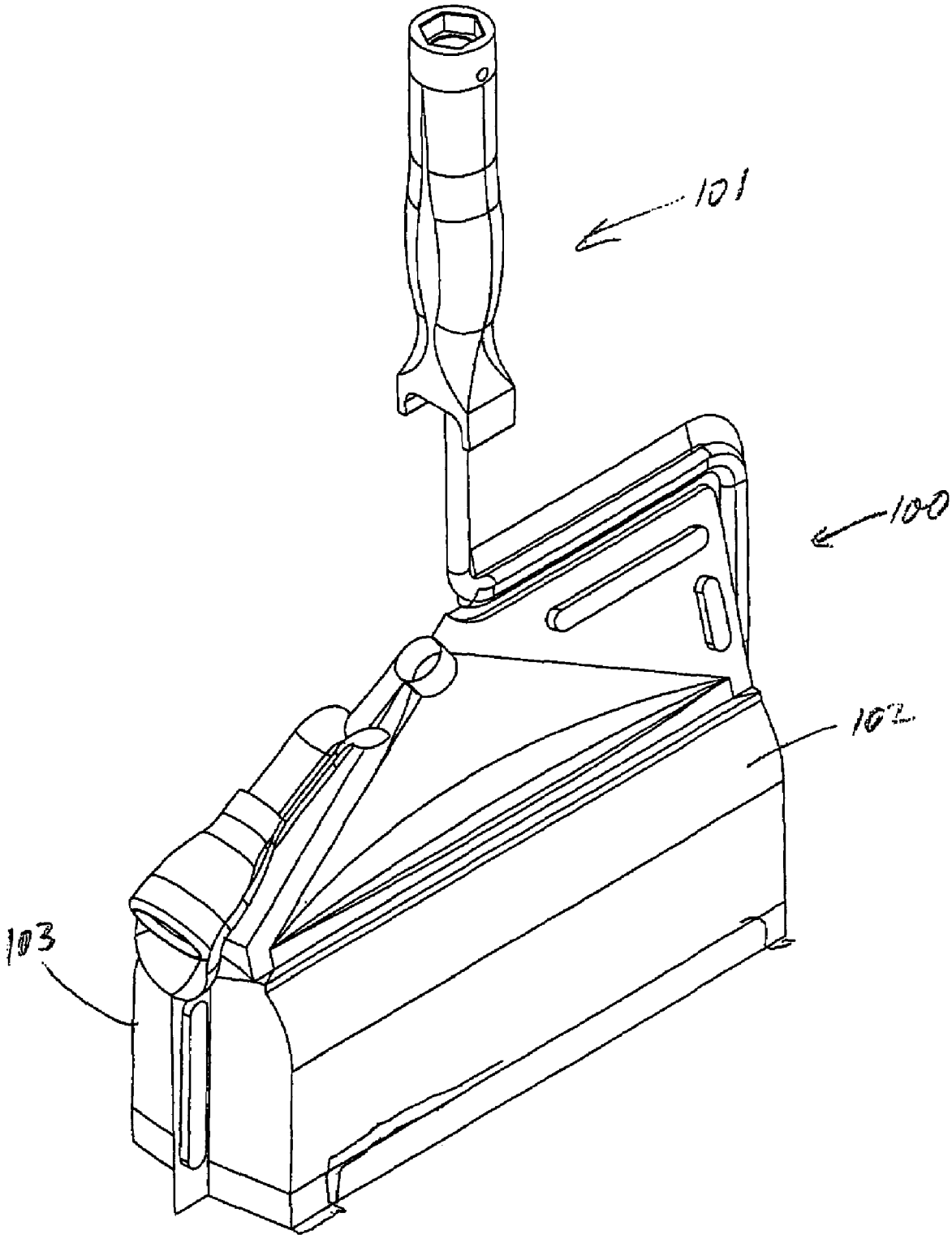

FIG. 26 is a perspective view of a third embodiment of the washing apparatus.

Figure 27:
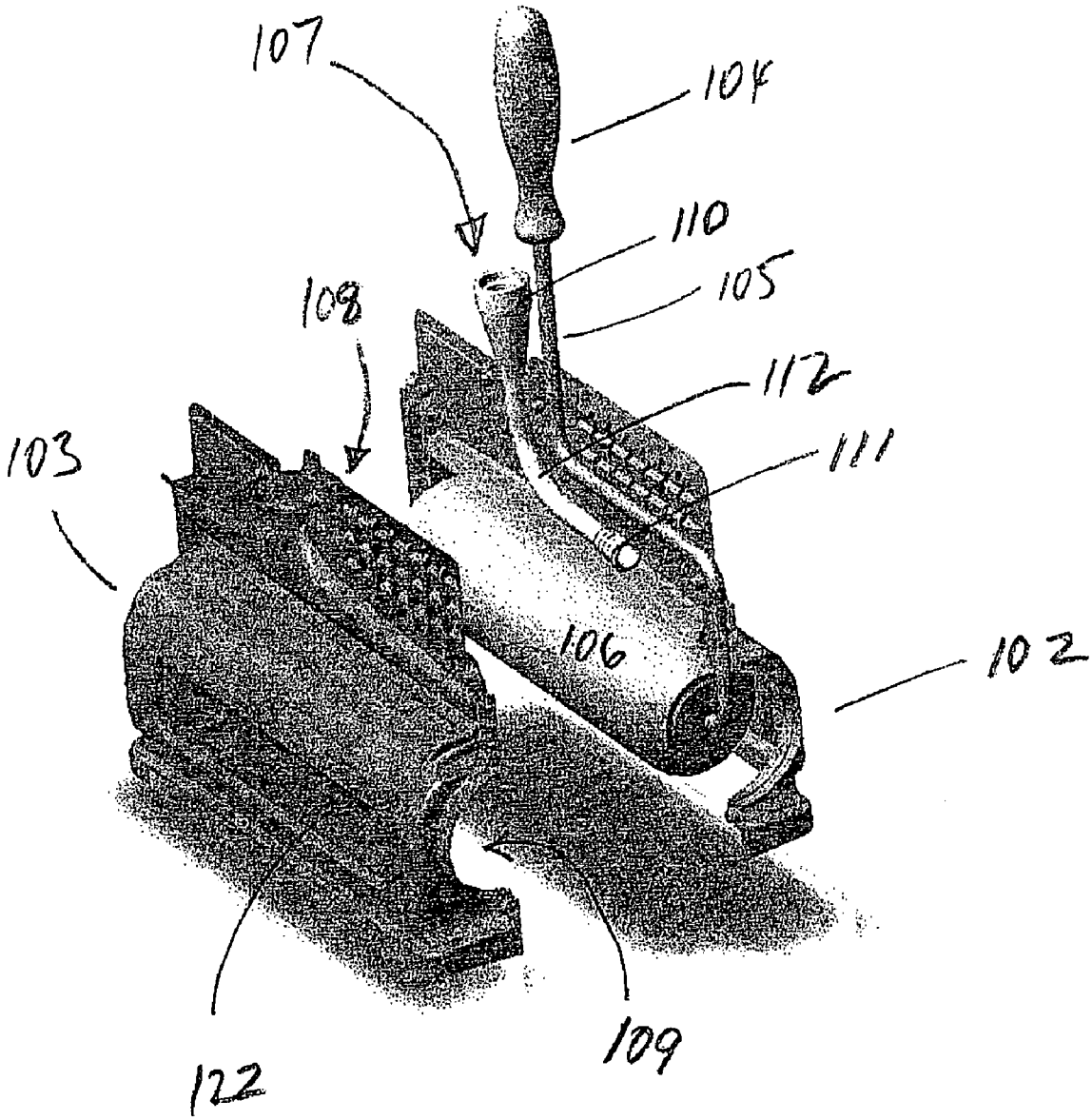

FIG. 27 is a perspective front view of the fourth embodiment of the invention an unassembled configuration.

Figure 28:
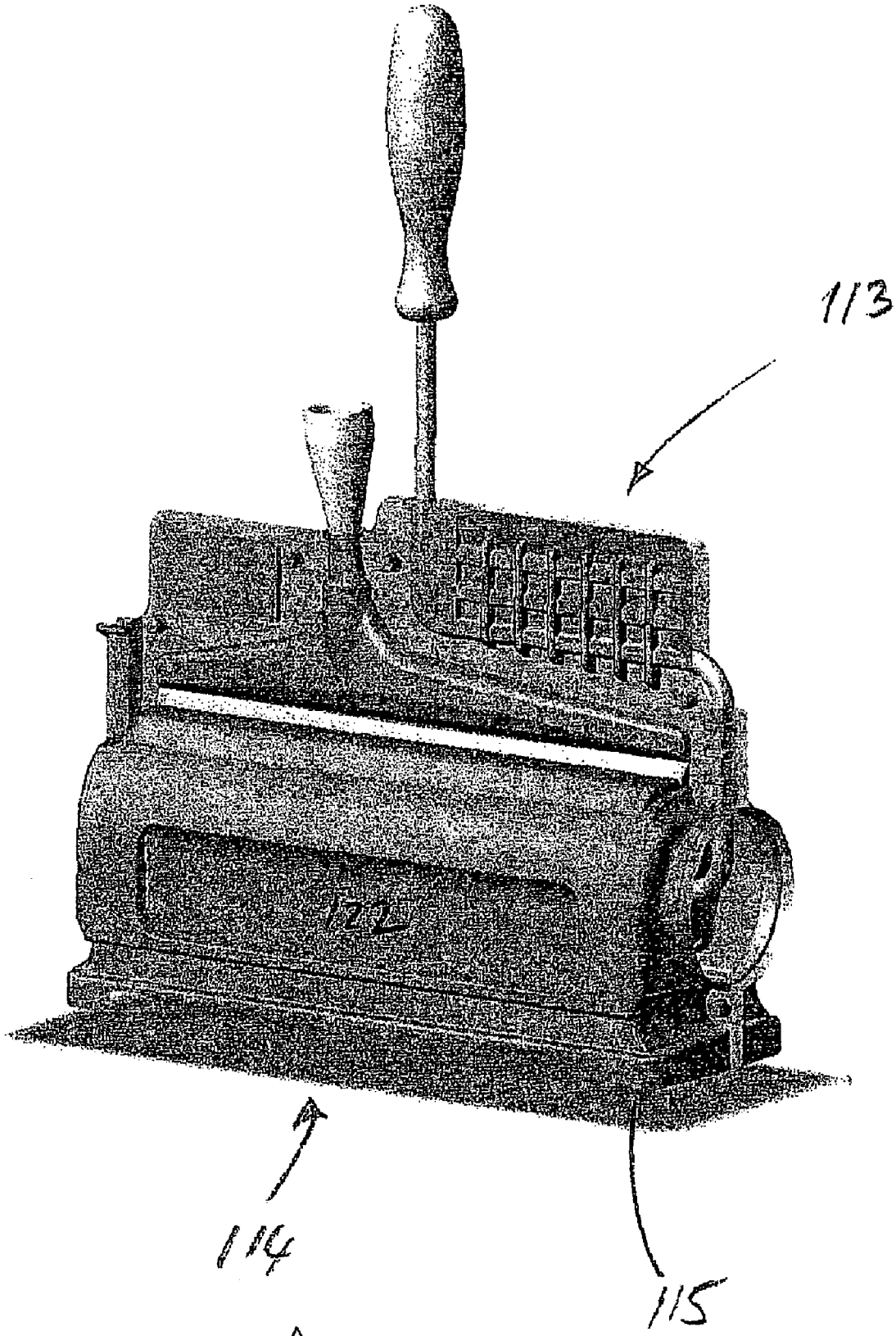

FIG. 28 is a perspective front view of the invention in an assembled configuration.

Figure 29:
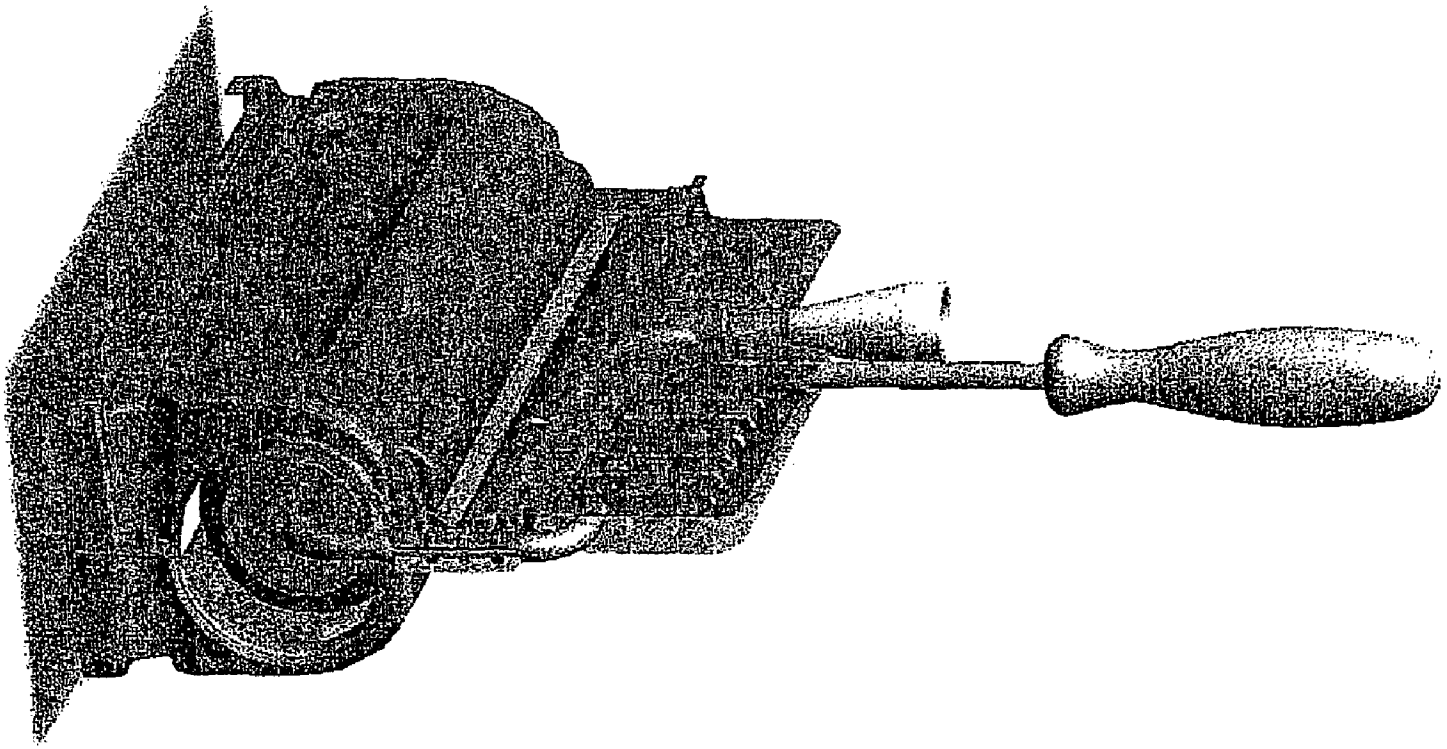

FIG. 29 is a perspective end view.

Figure 30:
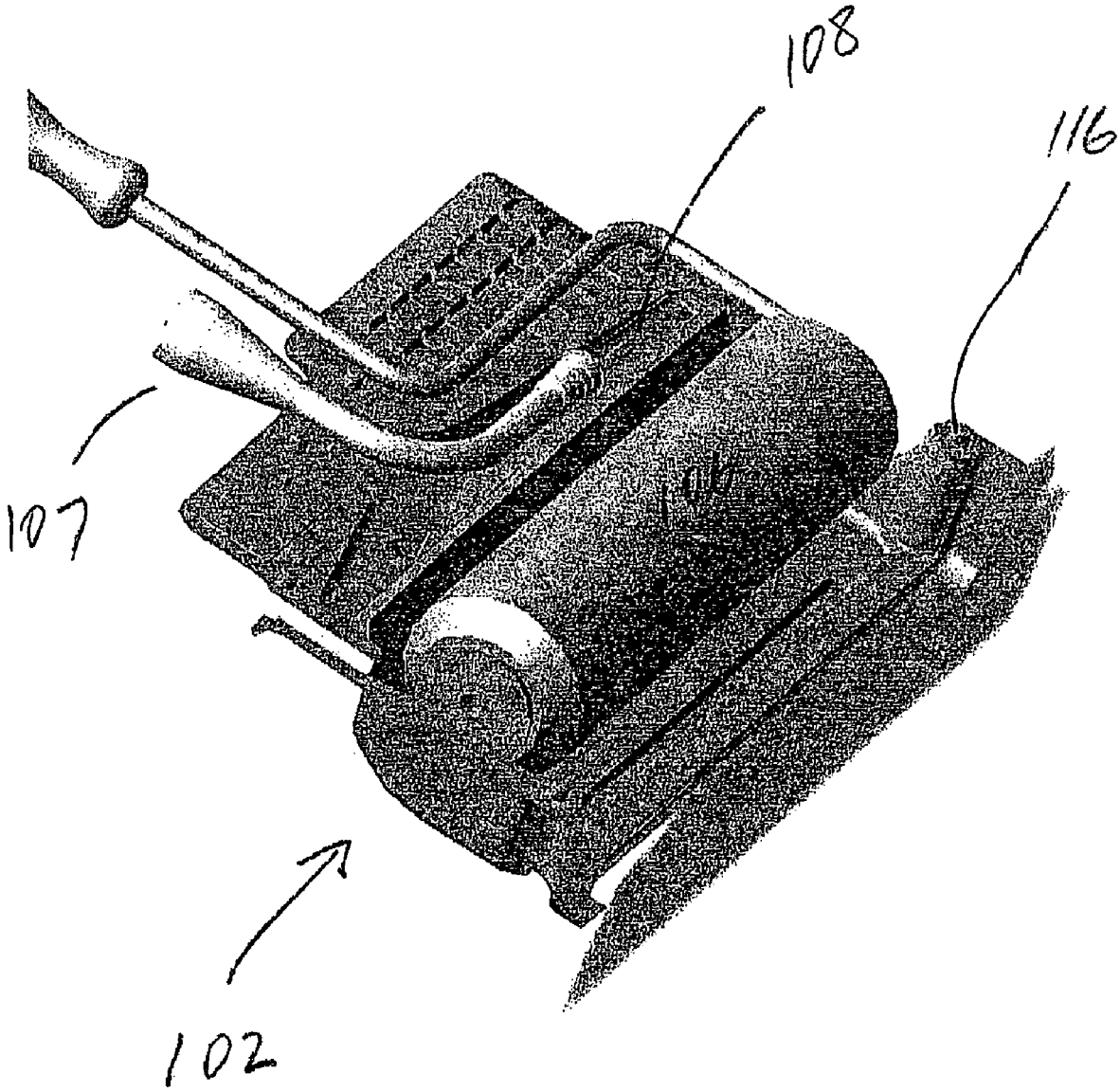

FIG. 30 is a perspective view of a first component.

Figure 31:
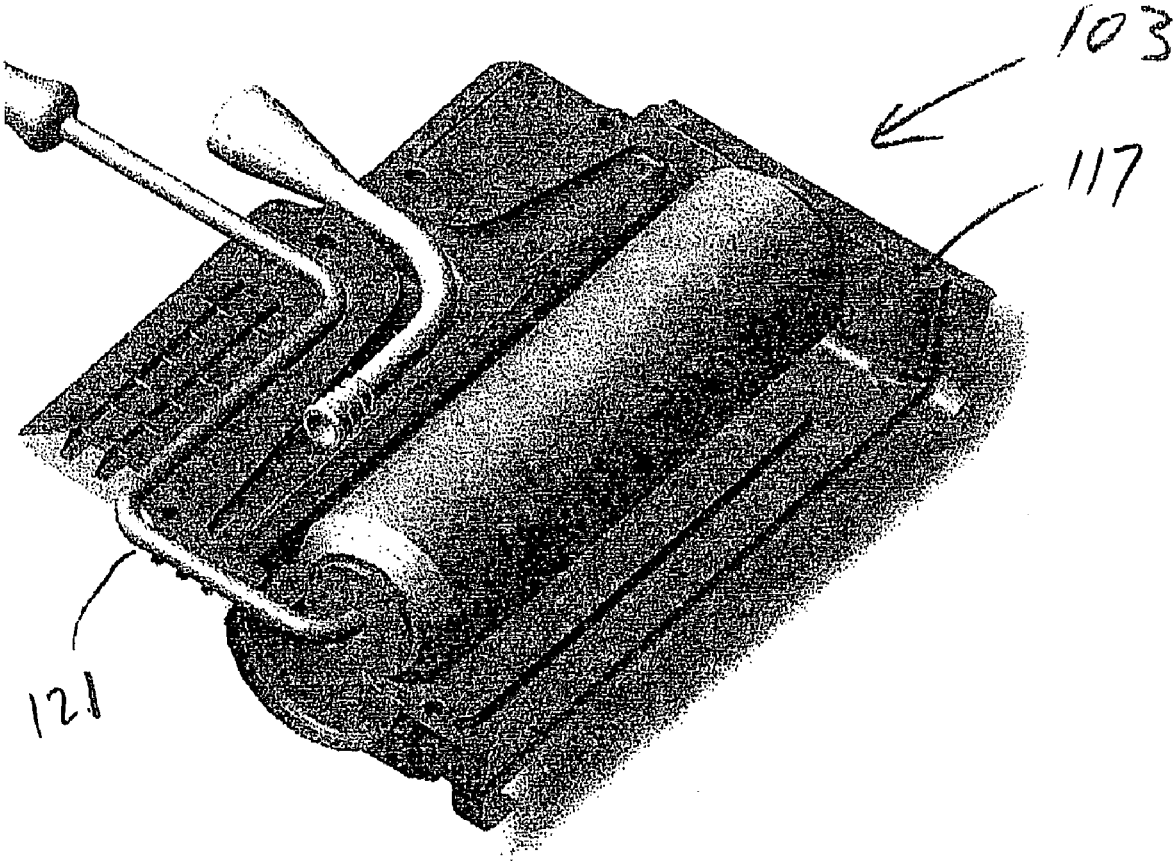

FIG. 31 is a perspective view of a second component.

Figure 32:
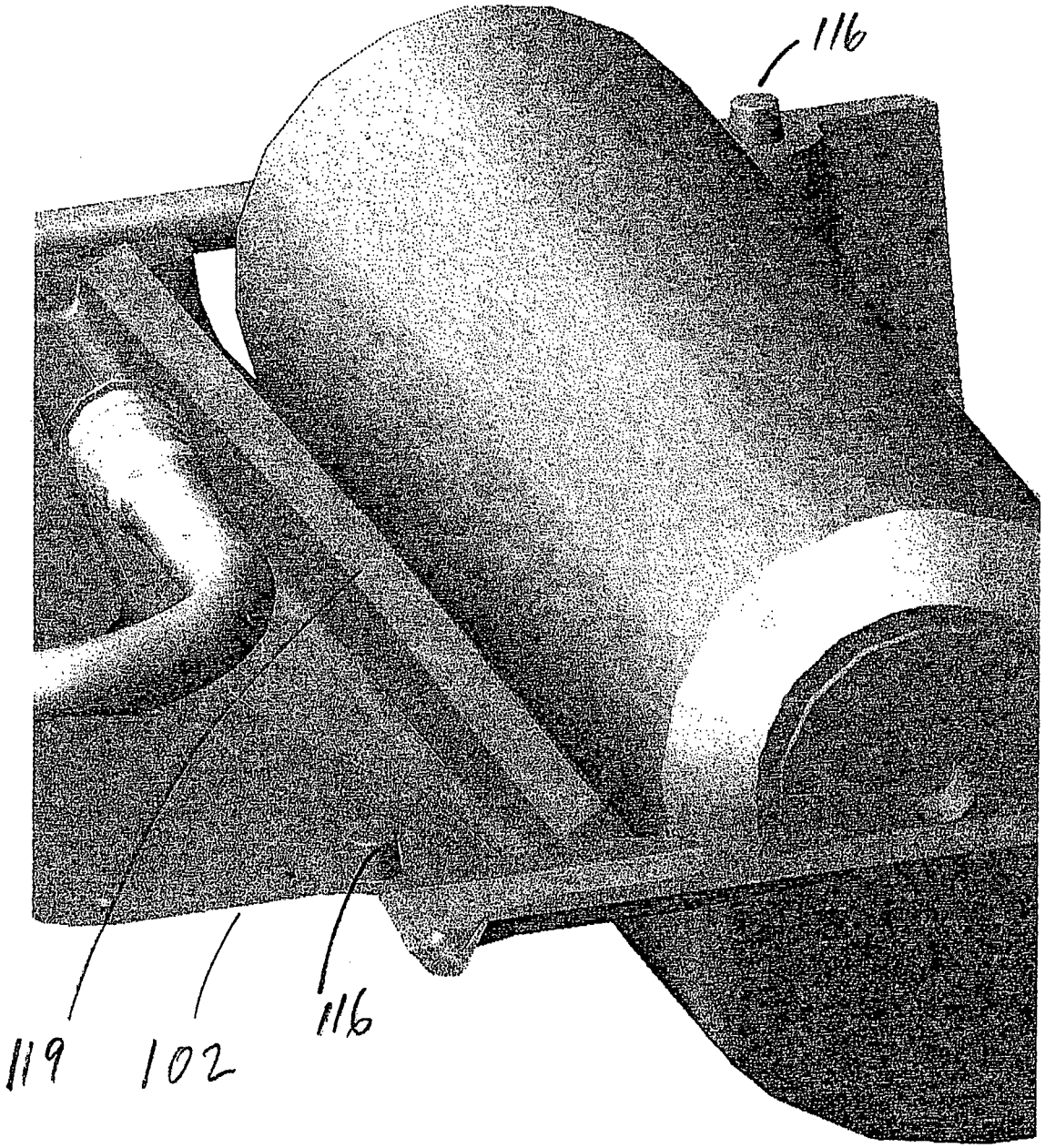

FIG. 32 is a close-up perspective view of the second component and aperture forming portion.

Figure 33:
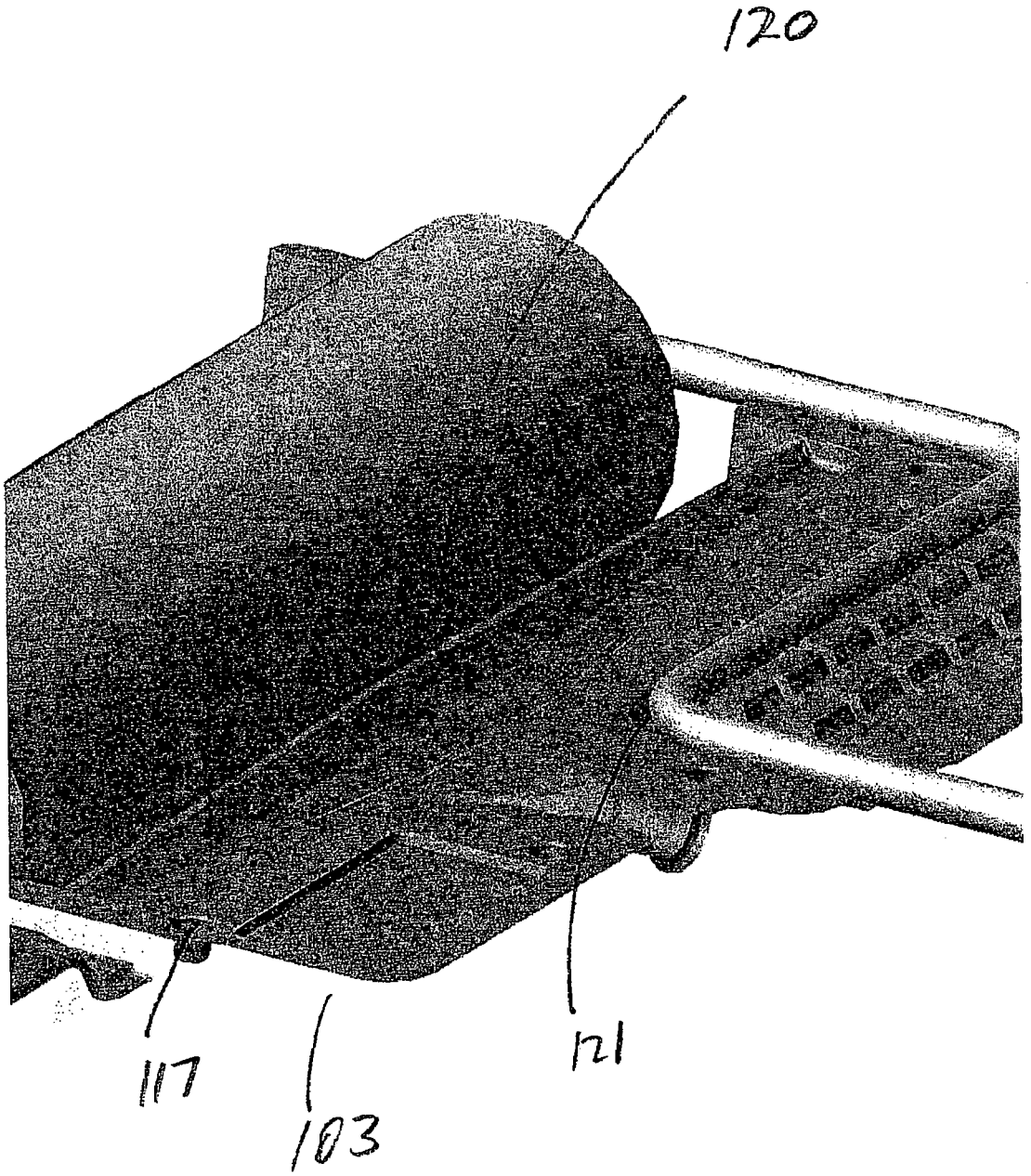

FIG. 33 is a close-up perspective view of the second component and aperture forming portion.

Figure 34:
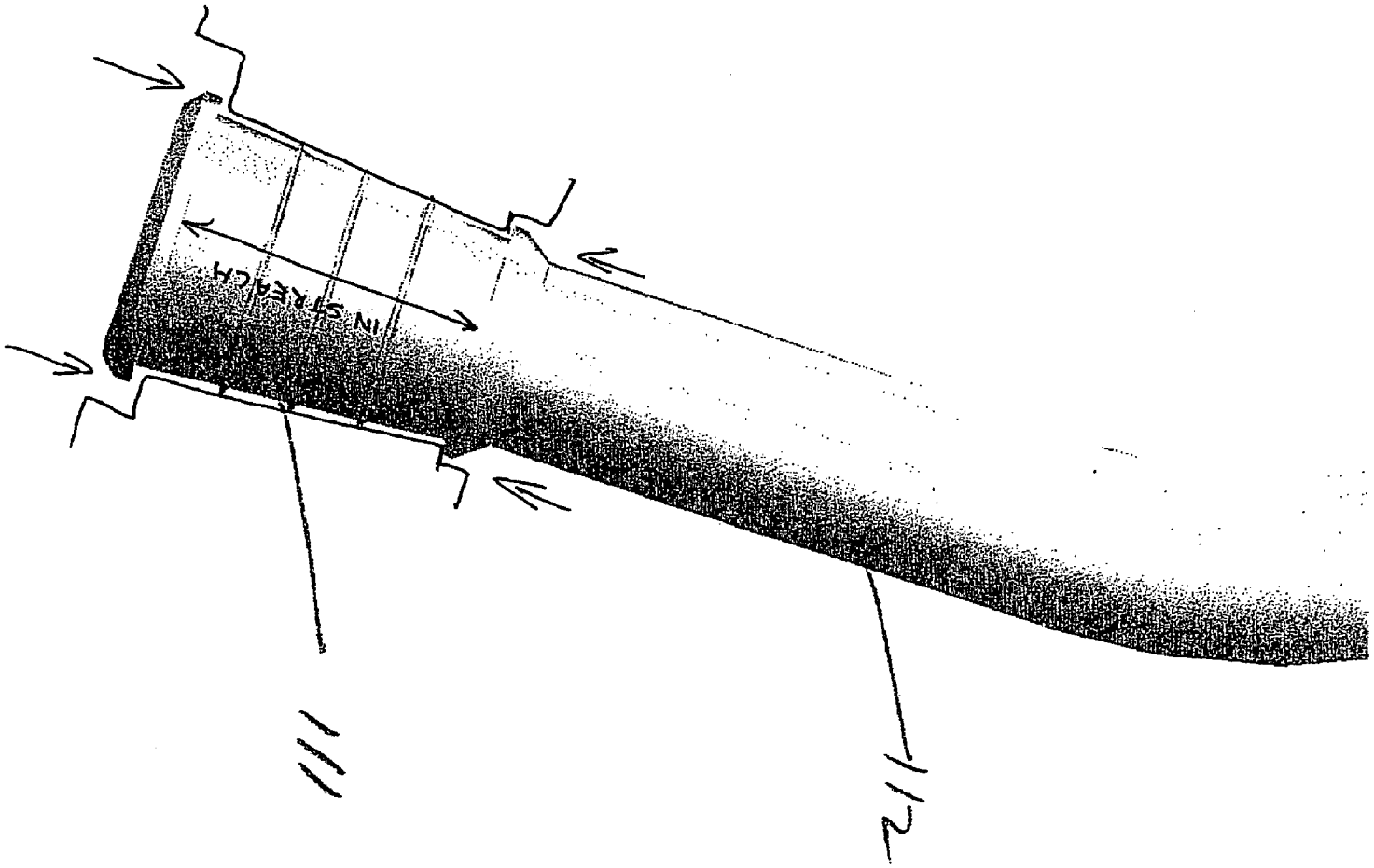

FIG. 34 is a close-up view of the distal end of the fluid inlet connection means.

DETAILED DESCRIPTION

Figure 1:
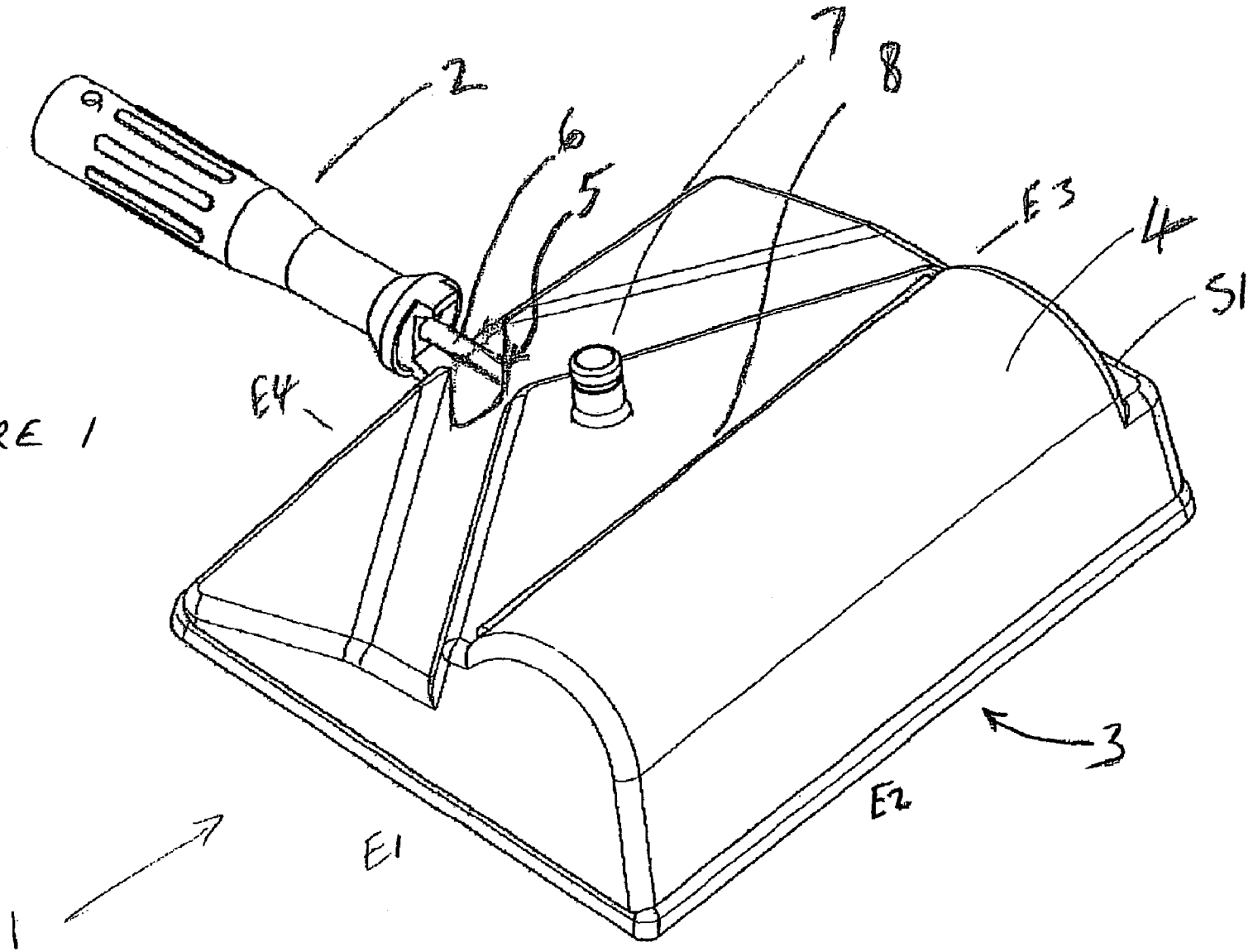
FIG. 1 shows a perspective view of the roller washing apparatus having the first part and roller shown with the fluid inlet facing the user.

FIG. 1 shows the washing apparatus 1 in use with a roller 2 in place. It is preferred to wash any rollers that are able to fit within the apparatus such as paint rollers that can be spun. A first part 3 is shaped to allow for the shape of the paint roller 2 or any other object that is to be cleaned. The first part 3 may have a protruding curve 4 of substantially the same shape as a roller wheel or sleeve (the sleeve having a nap). The first part has edges E1, E2, E3 and E4 And also an outer surface, which faces a user, and an inner surface distal to the user. The apparatus can be shaped to be stackable and or nestable with or without the roller in place. The dimensions of the apparatus can be selected to enable the apparatus to fit within standard paint trays and cover standard rollers.

The first part 3 has a slot or groove 5 to allow a shaft 6 of the paint roller 2 to fit therein such that the roller sits level in the first part 3. A fluid inlet in the form of a nozzle 7 is provided for connection to an external fluid source. The fluid is preferably water but could be or include another other suitable fluid or liquid or liquid mixtures/combinations for example detergents and or solvents. Alternatively or in combination to the groove 5 in the first part 3, the first part can have a tunnel portion or flaring 5*a* (see FIG. 10) that serves to strengthen the first part and stabilize the paint roller handle when inserted into the apparatus.

Various strengthening means such as protuberances or rib (s) or curving or angularity are also provided on the first part 3 and or the second part 9, to aid in the creation and maintenance of the spray. In particular strengthening rib 8 is provided to facilitate the washing operation by providing an even pressure spray of fluid from the elongate aperture. The strengthening means assists in maintaining pressure on the aperture for the maintenance of an even elongate spray by preventing the aperture opening too wide under pressure by the flexible nature of the materials that it is moulded from. The strengthening rib is moulded in such a way that an arc shaped fold is produced across the width of the first part or second part, that loads extra rigidity to the central area of the aperture in order to create an even elongate spray across its width. The central curving or rib assist in providing suitable resistance similar to the ends of the aperture so that substantially equal resistance is provided by the first part and second part to in turn provide a substantially uniformly sized aperture to then provide a substantially elongate spray.

Figures 2, 3:
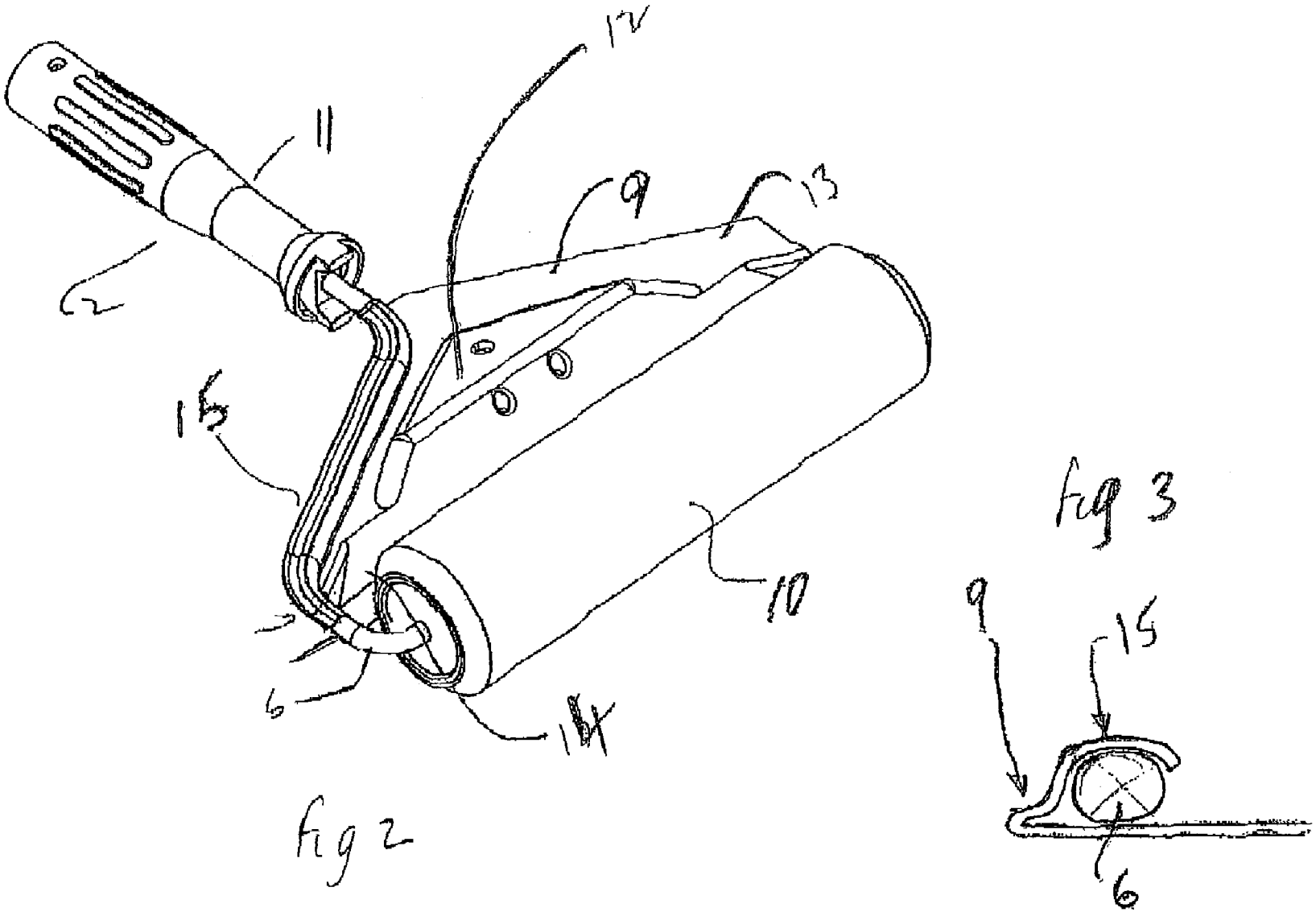
FIG. 2 shows a perspective view of the roller washing apparatus of FIG. 1 having the second part clipped to the roller shaft.
FIG. 3 shows a close up cross-section of the clip formation on the second part of FIG. 2 showing the formation of the spray.

FIG. 2 shows a second part 9 of the washing apparatus. The paint roller 2 has a wheel 10 joined to the shaft 6 which is in turn joined to a handle 11. The wheel can have an exposed surface or the exposed surface may be covered by a bristled roll or nap. The second part 9 is provided with a holding means to hold the shaft 6 of the paint roller 2. The second part 9 may also have a recess portion 12, flat portions 13 and angled portions 14. The holding means is preferably in the form of a clipping action of a lip 15.

As an alternative to or in combination with the lip 15 to hold the paint roller shaft in place, there is at least one landing means provided as part of the first part or as an added portion (s). As shown in FIGS. 10-12 a first and second landing means 15*a* or 15*b* can be made up of merely a recessed or channel portion having a partial roof portion. The first landing means 15*a* is situated adjacent the roller handle holding portion of the first part edge E4. The second landing means 15*b* is situated in the first part portion adjacent the end of the shield portion 4 in a stepped portion S1 of the edge E1 of the first part.

The first landing means can be made up of a channel portion 30 having a side portion 31 and a roof portion 32. There can be a landing member 33 to further retain the shaft 6 in place. The second landing means 15*b* has a channel portion 34 having side portion 35 and a roof portion 36. The channel can have a landing member 37 to further form the channel to hold the shaft in place. In use the roller handle can be fitted in the roofed channel portion by resiliently bending the first part and landing member(s) such that the shaft snaps fits into place.

To put the roller in the first part 3 is flipped over to expose the underside. When the shaft 6 is located by the landing means the roller is held in a non-level manner. However when one wishes to commence washing the first part 3 is flipped back over whereby the roller is wet, it is forced into a level configuration.

FIG. 3 shows the lip 15, which is just one form of the holding means to hold the shaft 6 of the roller 2 in place. Other forms of holding means could be a series of tabs or prongs. See other forms of holding shaft 6 in place on the first part 3, 9 in FIGS. 10-12.

A plan view and two end views of the roller washing apparatus of FIG. 1 are shown in FIGS. 4-6.

As shown in the cross-section of FIG. 7, the two parts 3 & 9 of the washing apparatus are shown joined along edges together to form a cavity 16 for water. The joining of the first and second parts 3 & 9 can be provided by any means that enables a substantially watertight seal to be achieved. Not all edges of the cavity 16 need to be joined. In one form of the invention (see FIG. 8) at least one edge 18 & 19 of the first and second parts is left unjoined to provide an outlet aperture 20 for the water. The edge 18 or 19 could also be strengthening or shaped as required. For example edge 18 or 19 could be curved towards the middle to enhance the spray shape or intensity. This cavity edge being parallel to the strengthening rib 8 of the first part, allows a spray 17 to form.

Alternatively, the first part 3 can be integrally joined to the second part 9 while still leaving the at least one unjoined edge. In yet another alternative one edge could cut open in another step. Alternatively to the unjoined edge or openable aperture 20 there could be a series of fine or small apertures of holes. The joining means can be provided by welding or by gluing, screwing or capping etc.

Also shown is the water inlet or nozzle 7, on the outer surface of the first part 3 which is generally for connecting to a hose or tubing. The nozzle 7 of FIG. 7 is shown as a separate item which can be bought off the shelf and captured within the first and second parts of the apparatus as part of the welding, gluing, screwing or capping etc operation or purpose manufactured to international standard hose coupling specifications. The nozzle 7 can be placed in a hole cut in the first surface of the first part 3. Alternatively this nozzle 7 can be integrally moulded with the first part 3.

As shown in FIG. 8 there is a close up of part of the cavity 16 and first part and second part 3 & 9 which allows an elongate spray of water or a jet spray of water 17 onto the top edge of roller wheel or standard roller sleeve 10 to occur. The first part 3 is joined to the second part 9 by a weld along all the edges of second part 9 except for at least one edge. When the second part 9 is joined together with the first part 3, at least one edge 18 & 19 of the first and second parts 3 & 9 is not joined or welded thereto. This edge is usually elongate in shape. This edge that is not joined or welded provides an outlet aperture 20 for the water. Without the water in the cavity there would be no aperture 20 but a 'kissing' of the two unjoined edges 18 & 19. As the water fills up the cavity 16 the water pressure builds up till the two unjoined edges 18 & 19 eventually part and the spray 17 forms substantially all along the length of the unjoined edge which is preferably elongate in shape. The first part 3 as previously stated is also reinforced or strengthened 8 to help produce and maintain the uniform elongate aperture that is created by the water pressure exiting the cavity 16.

As an alternative to the cross section of the openable aperture of FIG. 8, there are the cross sections of FIGS. 8*a*, 8*b*. Instead of the rib 12 there can be a vertical portion 12*a* of FIG. 8*a*. Alternatively as shown in FIG. 8*b* there can be a stepped portion 12*b*.

FIG. 9 shows the roller washing apparatus with the roller in place from underneath clearly showing the slot 5 in the first part 3 which allows the shaft 6 of the roller 2 to slide through when installing.

To use the washing apparatus of the invention there are a few simple steps to perform. Firstly put a paint roller into the second part 9. This is done by clipping the shaft 6 of the roller 2 onto the clip 15 of the second part 9. Once the roller is in place, then attach a hose to the nozzle 7 and turn the fluid on. In an alternative method of installing a paint roller, using the first part 3 having the landing means, one should put the roller end 10 in first whereby the shaft 6 is inserted into the second landing member 15*b*, followed by insertion of the shaft 6 into the first landing means 15*a* nearest to the roller handle 2. This action of fitting the shaft with the landing members uses the resilience or memory of the plastics material to snap fit into place. The roller 2 should now be positively held in place and should be level when wet.

Any type of liquid can be used in washing though water or a water based solution or a solvent can be used. In using a solvent the material used in the apparatus will be altered to suit. In water then fills the cavity 16. The water pressure builds up in the cavity 16 to a point at which the water tries to exit through the openable aperture 20 which is initially closed. In one option for convenience the apparatus can be sized to fit within a standard paint tray.

The aperture 20 which is eventually formed is substantially elongate. With the continuing water pressure, water spurts out of aperture 20 as a jet and sprays onto the roller wheel or standard paint roller sleeve 10 in a tangential fashion. As the water is being sprayed tangentially the roller wheel or sleeve 10 spins. The spinning of the wheel creates a centrifugal force and this centrifugal force helps push or drag the water flow through the bristles or nap of the roller wheel or sleeve 10 to mix and dilute the paint and exit therewith. The paint and water mixture flows out in the arrows shown in the FIG. 6 and into or over a drain, bucket or sink or any drainable surface or aperture as long as the washing apparatus has been conveniently placed or it could be placed on top of a large bucket or trough.

The first part can be any configuration that is desired e.g. the corners could be truncated. The nozzle 7 can be moulded as part of the first part 3 or added to the first part before the second part is added. The parts can then be joined. In one example the joining can be by welding at weld points such as at least at points A & B. This welding can also serve to limit the expansion of chamber 16 while under pressure of the fluid forced through the nozzle 7. This also assists in regulating the opening of the openable aperture 20. FIGS. 13 and 14 show another alternative, with the nozzle 7 connected to pedestal P to provide an angled nozzle inclination, to better facilitates fluid connection and entry. Other examples of joining are using adhesive or mechanical snap locking or suction.

The roller washing apparatus can be made by a vacuum forming or even injection moulding techniques can be used. Plastics or any other suitable material may be used but it is preferred that PVC say 0.5 mm-0.8 mm thick is used in this application. The plastics may also be UV treated. To produce the roller washing apparatus, the steps can be to initially heat the plastics that has been placed on the mould, next a vacuum is applied and the plastics is sucked down into the mould of the shape of the roller washing apparatus. The mould may also be angled to enable easy removal of the plastics. Next the plastics is removed from the mould and sent to a knife-cutting die. At this step all the waste plastics is removed. After the waste plastics is removed, the two parts of the apparatus, that is the upper part and the lower part are put together. They are put together using a welding die and this creates the cavity 16 that we need to have, to fill up with water to create the spray 17. Alternatively the first and second parts and or the water inlet can be integrally moulded.

FIGS. 15-25 show an alternative construction of the washing apparatus as previously shown in FIGS. 1-14 but with a different shaped first part 3 i.e. with corners CR truncated, the landing means being of different shapes, no flaring 5*a* and a different shaped fluid inlet 7. The same numbering used with FIGS. 1-14 has been used in these figures. The pedestal P is both welded at weld points and weld lines L for both strength and stability for both the apparatus and fluid inlet and resulting elongate spray.

The following description is now in relation to the third and fourth embodiments of the invention as covered by FIGS. 26 to 34 which concern a washing apparatus which can be either vertically standing or tap/faucet supporting. The fourth embodiment of the invention is covered by FIGS. 27 to 34. The washing apparatus 100 has an outer surface and an inner surface. The inner is forms cavities for washing and is designed to wash a roller apparatus 101. As shown in FIG. 26 the washing apparatus 100 is made up of a first part 102 and a second part 103. Each of these parts together form cavities that are labelled as one number, but in reality each part 102 and 103 has a portion of the formed cavity.

Washing apparatus 100 is provided with a first part 102 and a second part 103 that interfit together with a roller washer being made up of a handle 104 connected by a shaft 105 to a roller 106. A fluid connecting means 107 to supply washing fluid is also provided with the washing apparatus 100. The first part 102 and second part 103 together form a first cavity 108 and a second cavity 109 therebetween. Each part having a recess that fit together to form the cavities. The first cavity 109 form a fluidly sealed cavity which enables an elongate spray to be formed. The second cavity 109 is adapted and constructed to house roller 106 for washing. First and second cavities can be swapped in terms of use.

FIGS. 28 and 29 shows the washing apparatus in its assembled form, there being in use a closed upper end 113 and an open lower end 114 having feet 115 therein. So that in use the apparatus is able to sit in a general vertical orientation, to enable a roller apparatus to be inserted into the washing apparatus 100 so that the first cavity 108 which is connected by the fluid connecting means 107 and the roller 106 is held and suspended but allowed to freely spin, within second cavity 109 to be washed.

FIGS. 30 and 31 show the apparatus opened up to show the inside in parts. The first part 102 is shown in FIG. 30 where there are shown connecting points or nipples 116 which can be connected to matching female parts or recesses 117 in the second part 103. During the manufacturing process the two parts 102 and 103 are separately moulded and joined by any suitable fluid sealing means though a one part apparatus is also an option.

First part 102 has a raised portion 119 and second part 103 has a mutually opposing raised portion 120. The raised portions can be generally outwardly curved and in use in the assembled form able to formed the aperture. Without the curvature at the centre the centre portion is generally more flexible than the outer edges and is then able to flex relatively specifically when opposing external forces such as fluid pressure forces are applied, so that an uneven spray will be formed.

Aperture 118 which is for producing the elongate spray, is formed between the mutually opposing raised portions 119 and 120 when the first part 102 and 103 are put together during the manufacturing or after the moulding stage or during assembly. When the parts are put together, the mutually opposing raised or curved portions 119 and 120 are prestressed, they meet or compress substantially along their length such that they form a substantially closed straight line aperture to the potential entry of water. The curvature at the centre portion provides enough resistance when the two opposing parts are put together, to substantially match the resistance or stiffness provided at the ends of the aperture on either side of the centre. Without fluid pressure the aperture forms a straight line which is substantially closed to fluid. This then enables the aperture which is likely to be formed from a PVC material, to flex equally when under fluid pressure to produce a substantially equal aperture to in turn produce a substantially even elongate spray to spray the roller wheel which is hanging in the second cavity 109.

During the washing operation the elongate spray hits the roller tangentially causing the roller to spin, with the washing fluid being centrifugally forced to combine with any dirt or paint etc within the roller bristles, to be quickly and efficiently washed out. The dirty fluid exits the apparatus 100 through the base 113 and down the drain.

As shown in FIGS. 27-34, the connecting means which is made up of a nozzle portion 110 and which is connected by way of tubing 112 to a connecting distal end 111. When not in use the connecting means can lie in a retracted position within the first cavity 108 between the first part 102 and the second part 103. When in use one merely needs to pull the connecting means 107 by the nozzle 110 such that the tubing pulls out of exit point to first cavity 108 wherein a distal end 111 lies at the exit point of the fluid inlet. The fluid connecting means 107 has a series of spaced apart ribs having different dimensions and different shape such that when the connecting means is pulled out for use the distal end 111 is frictionally and fluidly held tight so that no water or fluid can leak out and effective seal to enable water to be inserted into the first cavity 108 so that under normal fluid pressure the elongate spray is formed. The connecting means optionally can be permanently extending to allow self supporting connection to a tap or faucet. This enables the apparatus to exit waste water into the sewer or waster-water/grey-water systems thereby better protecting the environment reducing pollution and diverting waste into storm-water drains and streams.

In use, one inserts the roller apparatus by slipping the shaft 105 into the side of the washing apparatus 100 and into a third cavity 121. As shown in FIGS. 30 and 31 third cavity 121 has a portion in parts 102 and 103. The shaft 105 is frictionally removably held in place so that the washing operation can occur.

Advertising and or marketing can be combined with the washing apparatus. For example, a recess or raised portion 122 on first and/or second part 102 & 103 (see FIG. 1) and further packaging, can be used to site labelling etc.

The roller washing apparatus can be made up of any suitable material such as plastics and can be in any form or texture such as clear to see whether cleaning is finished, it could be transparent, opaque, frosted, patterned or coloured or UV treated. Any variation or combination of these can be used. Any of these choices of material, texture or surface style can be combined with or be separate to advertising thereon or marketing gimmicks that are possible. For example this apparatus can be given away as packaging or sold as a promotional item bundled with for example a paint tray, roller or other loss leaders and sold to DIY outlets.

In a simplified manner there is a method of washing a roller in the washing apparatus which provides a housing comprising a spray means such that in use, fluid is forced through at least one aperture creating a substantially elongate spray onto at least one roller wheel or roller sleeve substantially causing the roller wheel to spin and be washed or cleaned wherein the following steps include:

- inserting roller therein by opening the apparatus or sliding the roller therein;
- connecting the apparatus to a water supply means such as a faucet or hose;
- initiating fluid flow to wash or clean the roller.

Other steps or variations in the above are also possible such as connecting to water or fluid supply before inserting the roller.

Variations

This invention may broadly be said to consist in the parts, elements and features referred to or indicated in the specification of the application individually or collectively in any and all combinations of any two or more of the parts, elements or features and where specific integers are mentioned herein which have no equivalents such equivalents are deemed to be incorporated herein as if individually set forth.

The aperture or spray means could also be created or formed from a fan spray nozzle rather than only being an openable aperture.

ADVANTAGES

Thus it can be seen that at least in the preferred forms, a washing apparatus is provided which has at least one of the following advantages:

- easy to use;
- able to be conveniently used in a wash basin;
- lightweight and recyclable;
- quick washing time;
- low water use;
- efficient cleaning;
- low purchase cost
- low manufacturing and tooling costs;
- convenient promotional and advertising vehicle and
- Low cost packaging device for paint rollers
- Reusable and self supporting on tap Throughout the description and claims of this specification the word "comprise" and variations of that word, such as "comprises" and "comprising", are not intended to exclude other additives, components, integers or steps.

What we claim is:

1. A washing apparatus which provides a housing comprising:

- a spray means such that in use, fluid is forced through at least one aperture creating a substantially elongate spray onto at least one roller wheel or roller sleeve substantially causing the roller wheel to spin and be washed or cleaned, wherein the aperture is openable during use,
- wherein the housing in use is provided by a first part and a second part,
- wherein the first part has an outer surface, which first part in use faces a user and an inner surface which is distal to the user,
- wherein the first part and second part form a first cavity therebetween, being constructed to produce the spray means,
- wherein the first cavity is provided with a fluid inlet and a fluid outlet, and
- wherein the fluid outlet forms the openable aperture.

2. The washing apparatus as claimed in claim 1 and the spray is applied to substantially the complete length of the roller.

3. The washing apparatus as claimed in claim 2 wherein the spray hits the roller in a tangential manner causing the roller to spin creating a centrifugal force, with the fluid and any contents in the roller, being thrown out of the roller.

4. The washing apparatus as claimed in claim 1, wherein, the first part has a strengthening means that assists in maintaining fluid pressure on the aperture for the maintenance of an even elongate spray by preventing the aperture from opening unequally at any point along the aperture.

5. The washing apparatus as claimed in claim 4 wherein the second part has a strengthening means that assists in the creation and maintenance of the elongate spray.

6. The washing apparatus as claimed in claim 5 wherein the strengthening means can be a raised portion is moulded in such a way with an arc shaped fold across its width, that loads extra rigidity to the central area of the aperture in order to create an even elongate spray across its width.

7. The washing apparatus as claimed in claim 6 wherein, at least one raised portion provides the strengthening means which can be mutually opposing curved portions of the first and second parts which are brought together during assembly of the apparatus, pre-stressing occurs in the centre to provide equal resistance such that the portions react substantially equally to produce a substantially even aperture and elongate spray therefrom.

8. The washing apparatus as claimed in claim 6 wherein the raised portion can be a curved or angled portion of a rib adjacent the aperture.

9. The washing apparatus as claimed in claim 8 wherein, the first part has a shield portion in the form of a recess in which the roller wheel or sleeve sits within but is spaced apart to be washed by an elongate spray directed at the top of the roller or sleeve.

10. The washing apparatus as claimed in claim 9 wherein in use the apparatus has a top and a base and the apparatus is adapted to sit vertically, wherein the base is provided with legs.

11. The washing apparatus as claimed in claim 10 wherein, the fluid inlet is provided with a connecting means, the connecting means having a nozzle and tubing having a cavity connecting distal end, which before use can be in a retracted position or not within the first cavity such that during use, that the connecting distal end is frictionally held at the fluid inlet and the nozzle is removably connectable to a fluid supply thereby allowing the apparatus to be useable by being attachable to a faucet adjacent to a sink or drain.

12. The washing apparatus as claimed in claim 11 wherein the aperture is formed by two portions being pre-stressed or outwardly curved, to form a closed elongate aperture such that the aperture only opens evenly under predetermined fluid pressure to produce the elongate spray.

13. The washing apparatus as claimed in claim 12 wherein the first part has a lip portion with holding means to releasably hold a paint roller in place wherein the lip portion is designed to hold a section of the roller handle, rigidly to the apparatus when in use so as to prevent lateral or twist motion, by being captively retained when the first and second parts are together.

14. The washing apparatus as claimed in claim 13 wherein the first part has at least one landing means, in use to captively and releasably retain the shaft of a paint roller when used in the apparatus wherein a first landing means is provided in the inner surface of the first part closest to the handle portion of the paint roller and a second landing means is provided in the first part inner surface adjacent to an end of the roller when a roller in use is placed in the apparatus.

15. The washing apparatus as claimed in claim 14 wherein the first landing means comprises a grooved portion having a partial roof portion, adjacent an end wall of the first part and the second landing means comprises recess portion between a raised and non-raised pedestal portion.

16. The washing apparatus as claimed in claim 15 wherein the first part has a tunnel portion in use to envelop the handle part of a roller, distal to the handle end.

17. The washing apparatus as claimed in claim 16 wherein the washing apparatus is designed for multiple use with the roller being able to be extracted and installed repeatedly for washing as required.

18. A washing apparatus which provides a housing comprising:

a spray means such that in use, fluid is forced through at least one aperture creating a substantially elongate spray onto at least one roller wheel or roller sleeve substantially causing the roller wheel to spin and be washed or cleaned, wherein the aperture is openable during use and the spray is applied to substantially the complete length of the roller, wherein the spray hits the roller in a manner causing the roller to spin creating a centrifugal force, with the fluid and any contents in the roller, being thrown out of the roller, and wherein the housing in use is provided by a first part and a second part wherein the first part has an outer surface, which in use faces a user and an inner surface which is distal to the user wherein the first part and second part form a first cavity therebetween, being constructed to produce the spray means.

19. The washing apparatus as claimed in claim 18 wherein, the first cavity is provided with a fluid inlet and a fluid outlet wherein the fluid outlet forms the openable aperture.

20. The washing apparatus as claimed in claim 18 wherein, the first part has a strengthening means that assists in maintaining fluid pressure on the aperture for the maintenance of an even elongate spray by preventing the aperture from opening unequally at any point along the aperture.

* * * * *